United States Patent [19]

Enyi

[11] Patent Number: 4,560,170

[45] Date of Patent: Dec. 24, 1985

[54] NUKE AWARENESS GAME

[76] Inventor: Donatus O. Enyi, 2100 19th St., NW., Apartment #701, Washington, D.C. 20009

[21] Appl. No.: 622,628

[22] Filed: Jun. 20, 1984

[51] Int. Cl.[4] ..... A63F 3/00

[52] U.S. Cl. ..... 273/248; 273/290

[58] Field of Search ..... 273/248, 249, 250, 251, 273/252, 253, 254, 243, 242; D21/33, 34, 24

[56] References Cited

U.S. PATENT DOCUMENTS

| | | | |
|---|---|---|---|
| 1,505,071 | 8/1924 | Fraser | 273/252 |
| 2,743,107 | 4/1956 | Hollossy | 273/248 |
| 3,159,403 | 12/1964 | Glass et al. | 273/290 X |
| 4,289,313 | 9/1981 | Delamontagne | 273/256 |

FOREIGN PATENT DOCUMENTS

| | | | |
|---|---|---|---|
| 130817 | 12/1959 | U.S.S.R. | 273/243 |

*Primary Examiner*—Richard C. Pinkham
*Assistant Examiner*—Scott L. Brown
*Attorney, Agent, or Firm*—Cornell D. Cornish

[57] ABSTRACT

This invention provides a nuclear awareness game board apparatus, including a card deck and a game board on which are imprinted portions of a map of elements that are designed and correlated in a sequence for deliniating the human condition in a nuclear age between the heaven of survival and the hell of destruction. These elements are correlated by clock means, comprising a random number generator, the card deck and the map elements for governing the movement of the playing pieces on the board in a simple, educational game of skill and chance to be played by one or more players competing in pairs or as individuals, each player seeking to reach a goal by a succession of moves that involve mental simulation of nuclear age stress induced conditioning, fantasy, fears, strategy, foresight, planning and invention, as well as chance, enjoyment, suspense and challenge, in such a way as to educate the players to the heaven of invention for survival by requiring the players to say the word "negotiate" as a simulated offer to peacably settle disputes and potential disputes. The game pieces and tokens are selectively intergangeable and/or matable with each other. To this end, one or more tokens make up a piece according to the strategy used.

18 Claims, 19 Drawing Figures

NUKE AWARENESS GAME

BACKGROUND OF THE INVENTION

In the field of games, it is desirable to provide a war game, with or without a map, that combines the elements of strategic skill, foresight, planning, chance, suspense, challenge, and knowledge of warfare or geopolitics as an entertaining diversion for one or more players, since such games can also teach survival. Heretofore however, such games have been intended to teach survival more by aggression, confrontation and complete victory over an opponent than by peaceable means for negotiation such as were described on page A2 of the Apr. 12, 1984, New York Times, which is incorporated by reference herein. Additionally, these games have not fostered nuclear awareness by contrasting the heaven of survival with the hell of annihilation as a feature. In addition, it has been desirable to use such games creatively and actively in real time as a means for teaching survival by using peaceable means to settle simulated disputes before they escalate irretriveably into simulated nuclear warfare. Still further, it has been advantageous to provide an improved word and riddle game having means for correlating the use of specific words with the play of the game.

One survival game for teaching the dangers of geopolitics is described in U.S. Pat. No. 4,097,051. This game has a board surface in the form of a map having grid spaces along which playing pieces move. The playing pieces are assigned target sites by the role of dice. The object of the game is to move separate playing pieces a number of spaces for each role of the dice to assigned target sites. To carry out a designated but limited mission a player may try to impede the progress of the other players and, if required, one of the pieces will return to the starting point. Forbidden and danger zones are designated on the map to further impede movement of the playing pieces and contribute to the importance of strategy to the game. The means used tend to emphasize survival by limited action, and the elements of aggression and competition tend to be emphasized.

Another game that may be used as a teaching tool is described in U.S. Pat. No. 3,947,038. However, this invention principally involves survival by confrontation and the limited objectives of domination. It also involves sophisticated concepts of map making, such as latitudinal and longitudinal directions.

The battle situation game of U.S. Pat. No. 2,799,504 likewise teaches the art of survival by limited warfare involving battle-simulation, wherein two players are provided with various game pieces representing military components for executing limited maneuvers.

Likewise, the games of U.S. Pat. Nos. 1,300,368; 2,343,82; 3,155,391 and 4,415,160 are limited as teaching tools, because they involve the relatively minor dangers of flying and the limited objectives of non-nuclear bombs.

In U.S. Pat. No. 3,155,391, the game is complicated by a series of changeable squares that may be removed, replaced, or inverted to change the particular color according to the level of difficulty desired.

SUMMARY OF THE INVENTION

This invention provides a nuclear riddle and awareness game apparatus for teaching the heaven of survival by peaceable means. A magic word is used for achieving the heaven of survival. The magic work constitutes a simulated offer for peaceably settling disputes before escalating destructively into simulated nuclear conflict, which is simulated as a penalty to a single token or many tokens making up a piece.

The game board means has imprinted thereon a plurality of squares formed with distinctively color-coded playing paths, while the playing pieces are distinctively coded so as to be movable along the playing paths according to a sequence that is matched with respective paths. A first portion of the squares has distinctive first indicia for the players and playing pieces forming a first reward and penalty option zone intersecting with each of the playing paths. A second portion of the squares has distinctive second indicia different from the first indicia forming a beginning and ending second zone at the opposite ends of the playing paths.

A clock correlation means governs the movement of the tokens or pieces by setting a time limit for penalties up to the ultimate penalty of elimination from the game in a simulated nuclear event. A particular player is penalized if that player does not first communicate a magic word for the simulated heaven of survival, comprising a simulated offer to peacably settle disputes by the heaven of invention within the time limit set. One or more tokens may be penalized.

The zones of the clock correlation means also provide neutral means or means for advancing or retarding the penalty of the tokens and the pieces so as to randomly, arbitrarily, and sequentially extend or shorten the time limit for the penalty. One zone has graphic display means, including distinct indicia symbolizing simulated buzz words of the nuclear age. These buzz words are communicated when playing token or pieces land on the indicia so as to indicate to the players the awareness of hell from nuclear destruction and annihilation on the one hand, and the heaven of survival on the other. Such words involve the concept of a "nuke holocaust" by intention, as distinguished from a nuclear holocaust by what is defined as the "broken arrow" of accident that does not risk war, or by a "nuke-flash" that risks war.

The clock correlation means comprises a first reward penalty-option zone on the board with directions for picking cards symbolozing the hell of a nuclear event by terminating the time limit so as to penalize players who pick a card without first communicating the magic word "negotiate", or some other such word. The penalty-option squares provide a particular penalty comprising directions for causing the player whose piece lands on a first penalty-option square to return to a square close to the starting point. This would include directions to pick a card so as to shorten the time limit. However, the players are encouraged to learn how to survive by mastering the essential skill of communicating magic words adapted to settle disputes peacably before they escalate destructively, since this makes them immune from this particular penalty to their token or tokens making up a piece.

It is also advantageous to provide a simple game board apparatus, and playing pieces as a teaching device in a game that combines elements of strategy, chance, and knowledge of nuclear warfare, as an entertaining diversion for one or more players having one or more tokens selectively making up a piece.

It is an object of this invention, therefore, to overcome the problems of the heretofore known games by providing a simple game for one or more players for teaching the art of peacably settling disputes and potential disputes before they escalate destructively to a token or piece of tokens.

It is another object to stimulate the use of specific magic words that simulate an offer to peacably settle disputes and potential disputes by graduated predictable means;

It is another object to provide a game with novel tokens, teaching labels and instructions;

It is another object to provide a game with novel components for playing the game;

It is a still further object to provide a game with novel textual material, designs, apparatus and articles of manufacture.

With the proper selection of elements and their location and use, as described in more detail hereinafter in connection with the accompanying drawings, the desired game is achieved;

The above and further novel features and objects will appear more fully from the following detailed description when read in connection with the accompanying drawings of the preferred embodiments, and the novel features will be pointed out in the appended claims. It is to be expressly understood, however, that the drawings are for the purpose of illustration only and are not intended as a definition of the invention.

BRIEF DESCRIPTION OF THE DRAWINGS

In the drawings, where like means are referenced alike:

FIG. 1 is a plan view of one game of the invention with an ornamental serpentine design and enclosed spaces applied to an article of manufacture, such as the game board, by printing, painting, drawing, impression, photography or the like. In FIG. 1, however, the path lines and colors are shown without lettering, etc., whereas

FIG's. 2*a*–2*l* are various different views that illustrate the games pieces for the board of FIG. 1 with selectively matable tokens FIG's. 2*a*–2*b* are tokens joined as pieces by round means; FIG's. 2*c*, 2*e*, 2*g*, and 2*i* are red, blue, black and green tokens.

DESCRIPTION OF THE PREFERRED EMBODIMENT

This invention is useful as a game and, as such, is useful for the wide variety of applications to which games have been used. More particularly, this invention is useful as a nuclear awareness game for enjoyment and education. Also, this invention is useful for teaching the use of so-called magic words for survival by peacably settling disputes and potential disputes before they escalate destructively. In one embodiment where one object of the game is to move the playing pieces back and forth by the roll of dice between a starting point and a goal at the opposite ends of color-coded playing paths, this game is additionally useful for simulating nuclear age stress.

In order to maximize the use of this game as a teaching aid, means are provided for focusing the player's stress by using oral communication of underlying confidences and concerns in a nuclear age by rules and directions of the game. These rules and directions direct players to be "good" listeners by making eye contact, not interupting, or not finishing the communicator's sentence. It has been found that these habits tend to decrease anxiety and stress whereas poor habits of communication and listening have the opposite effects, as understood also from TABLE $I_1$.

Additionally, at a more sophiscated level, the players may practice role playing, which includes learning body language. This is stated as a rule of the game in the directions thereof, as will also be understood from TABLE $I_1$.

The principle components of this game are quite simple. Thus, underlying elements may be used for a variety of psychological purposes. The latter includes game board mapping for delineating the human condition between the heaven of survival and the hell of destruction. Game board mapping simulates real world elements that are correlated by the use of certain "magic" words with the play of the game in a useful way. The time limit is a means for correlating the position of the pieces with the game board squares in accordance with a sequence of moves in which a player may be penalized for not saying a magic word for achieving peacable survival. To this end, the playing pieces are made up of one or more tokens that are selectively coupled and/or decoupled by electric, magnetic and/or mechanical means so that the token or tokens of farthest advance are penalized according to the strategy used.

THE GAME

This invention is a nuclear riddle and awareness game, and may have a variety of names. The preferred name is "Nuke Awareness", or "Nuclear Weapon Awareness" or "Nuclear Riddle and Awareness Game." The preferred embodiment comprises a rectangular game board with the name imprinted thereon.

Figure 1:
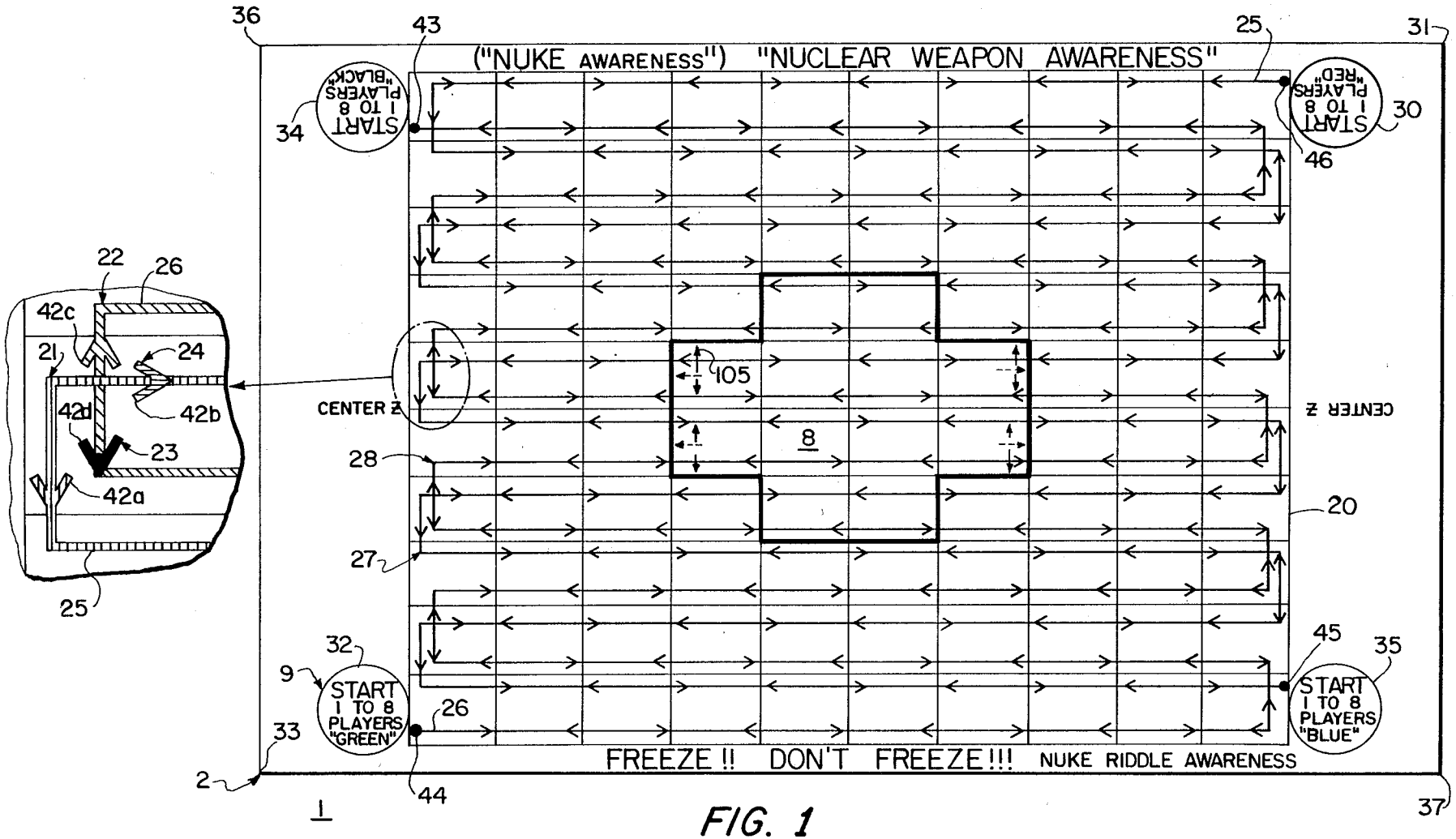
Figure 1A:
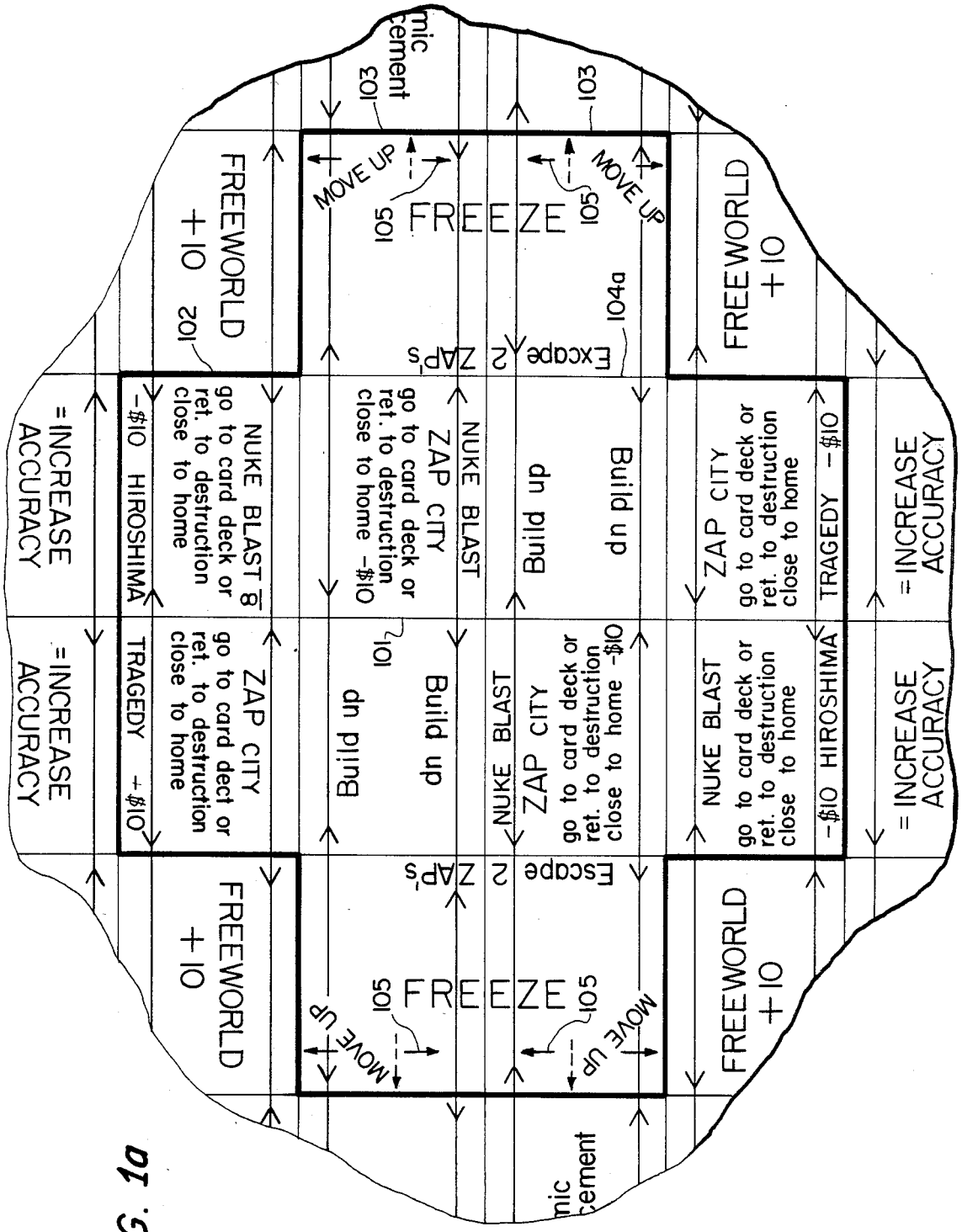
FIG. 1*a* is a cut-away plan of the center zone of FIG. 1; and FIG's. 1*b* and 1*c* are plan views of the adjoining ¼'s of the bottom half of the board of FIG. 1, which are reverse images of the adjoining ¼'s of the top half of the board of FIG. 1.
Figure 1B:
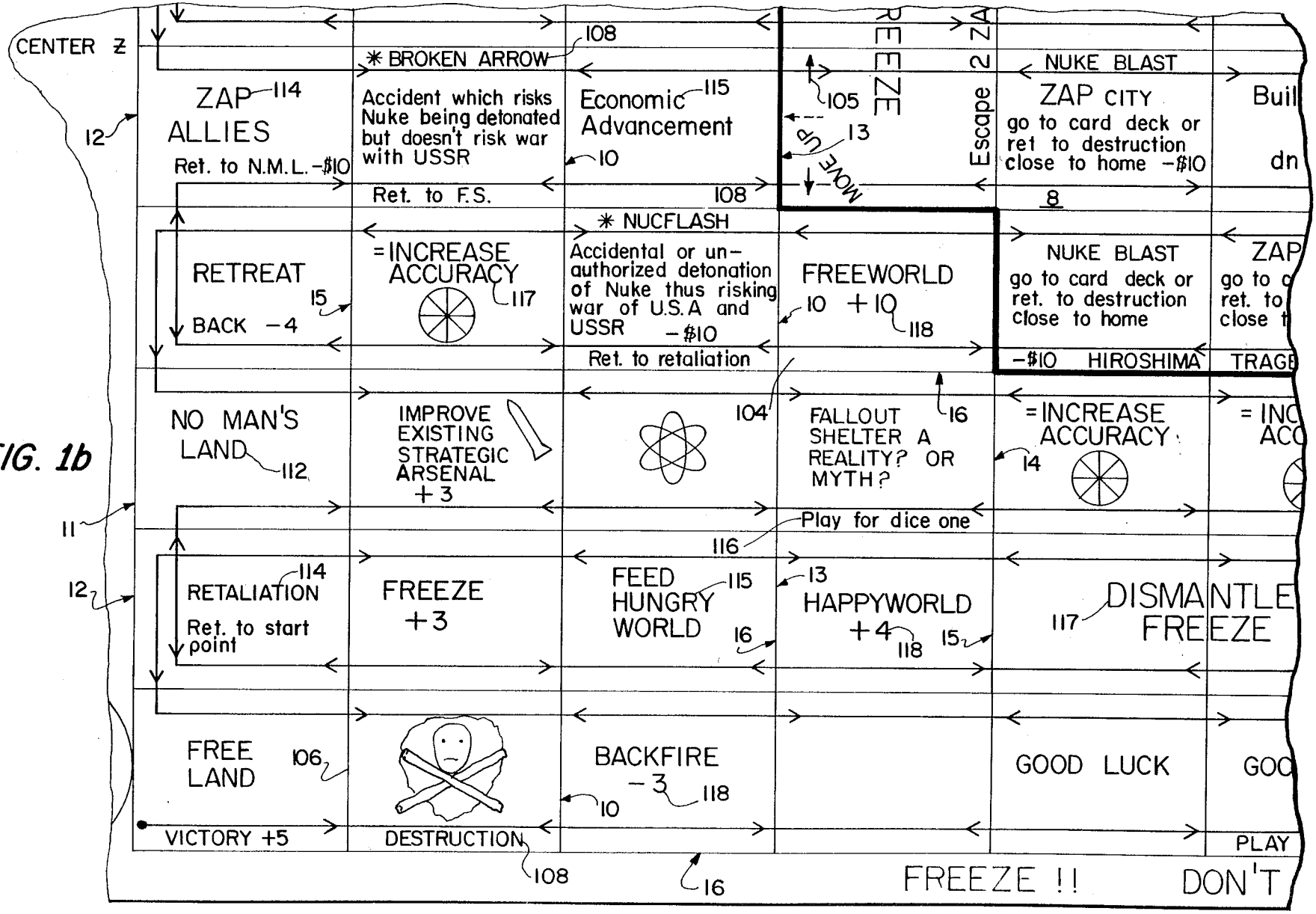
Figure 1C:
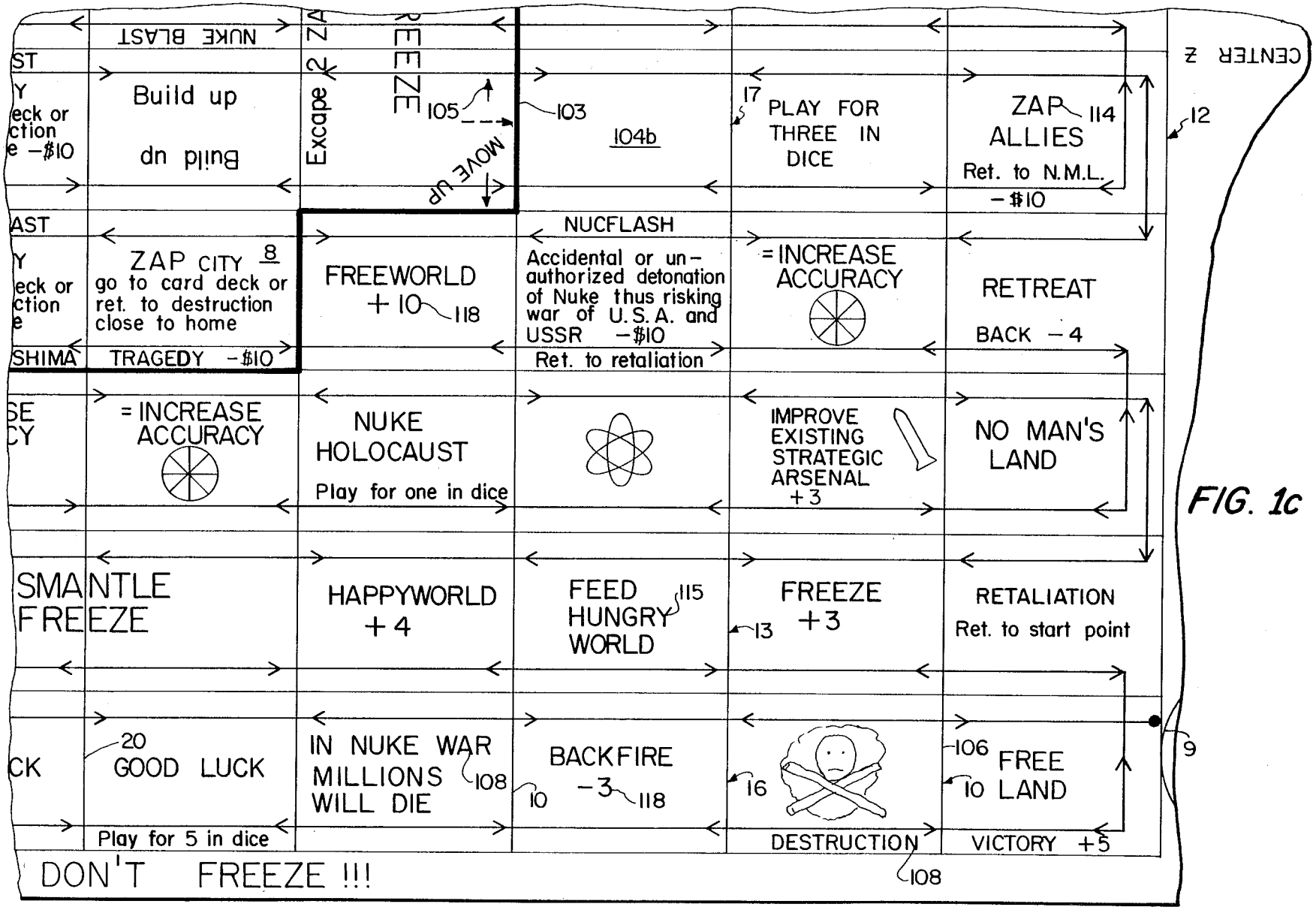
Figure 2A:
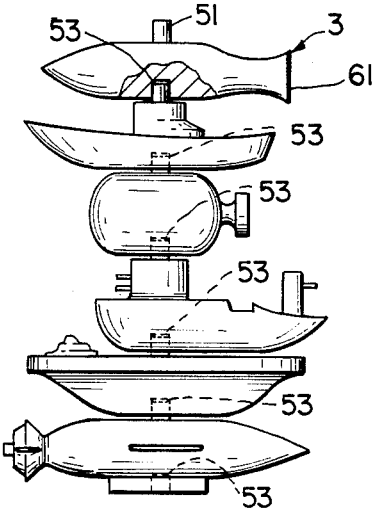
FIG. 2*d* is side view.
FIG. 2*f* is top view of FIG. 2*e*.
FIG. 2*k* is cross-section of magnetized iron metal of FIG. 2*l*.
FIG. 2*i* is front view FIG. 2*j*; and FIG's. 2*b*, 2*d*, 2*f*, 2*h*, 2*j* and 2*l* are striped tokens with joining means including male and female means that are round in cross section
Figure 2B:
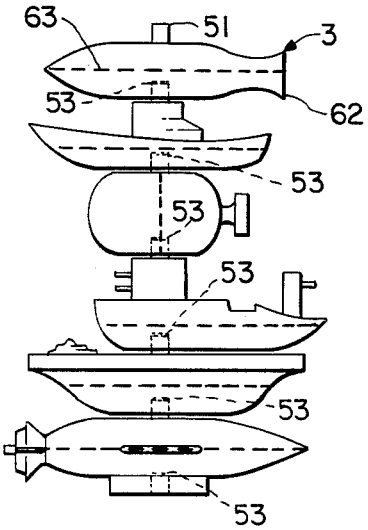
Figure 2C:
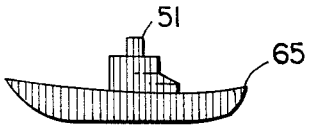
Figure 2D:
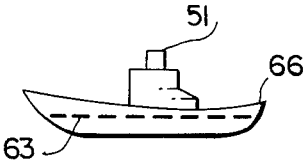
Figure 2E:
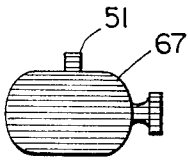
Figure 2F:
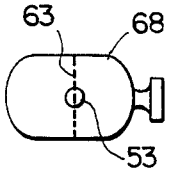
Figure 2G:
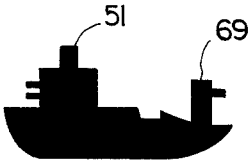
Figure 2H:
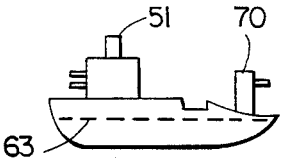
Figure 2I:
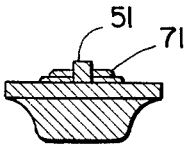
Figure 2J:
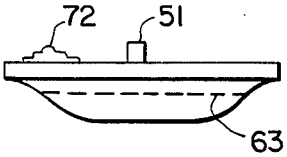
Figure 2K:
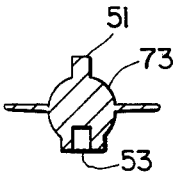
Figure 2L:
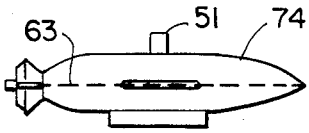
Figure 3:
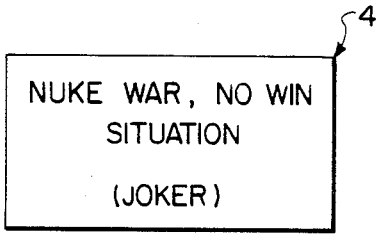
FIG. 3 is a partial plan view that illustrates sample cards from the card deck that is used with the squares of FIG. 1 so as to form another part of the clock correlation means of this invention.

The principle parts of the game 1 of this invention, comprise a game board 2, as shown in FIG's. 1; playing pieces 3 as shown in FIGS. 2*a*–2*l*; a card deck 4, as illustrated in FIG. 3; and clock correlation means 5, the parts of which are illustrated in FIGS. 1–5, having a random number generator 6, e.g., with computor connected keys 7 and 7*a*, and a display screen 7*b*. Also, the clock correlation means involves zones 8–17 on the board 2 for influencing the play, e.g., by retarding or advancing the movement of the pieces 3, and/or by supplying words of nuclear awareness that are communicated from one player to the others. One or more tokens make up a piece.

Figure 4:
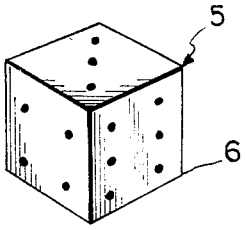
FIG. 4 is a partial three-dimensional view of a random number generatorfor the playing pieces of FIGS. 2*a*–2*l* and the clock correlation means of FIGS. 1 and 3.
Figure 5:
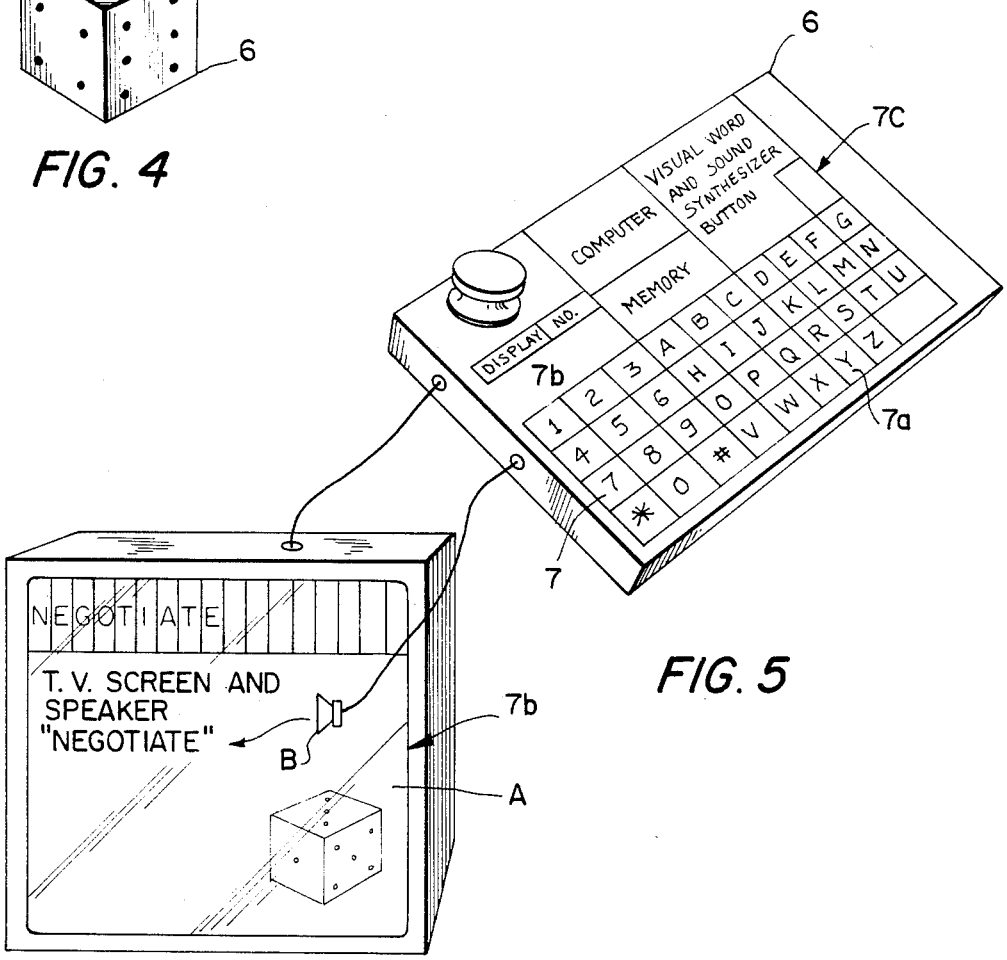
FIG. 5 is a partial three-dimensional view of another embodiment of the random number generator of FIG. 4.

The clock correlation means 5, comprises the card deck 4 for setting a time limit, which as will be understood from FIG. 3, is for teaching the use of the "magic" words of this game. It also comprises a random number generator 6. One embodiment of the random number generator is illustrated in FIG. 4 as at least one die, which is well known to come in any number from 1–6 inclusive. One to three or more standard dice are used as the number generators. However, as illustrated in FIG. 5, the random number generator may have a computer generator and screen A and synthesizer speaker B.

THE RANDOM NUMBER GENERATOR

The random number generator 6 is part of the clock correlation means 5 for governing the movement of the pieces 3 by setting a time limit. If a player does not first communicate a magic word, comprising a simulated offer to peacably settle disputes within the time limit, that player is penalized. The time limit is set to be the time within which a player is directed to pick a card from the card deck.

In the preferred embodiment the random number generator of this invention comprises from one to six conventional dice, one of which is illustrated in FIG. 4. This random number generator is used to move the pieces a number of grid squares corresponding to the random number generated by the die or dice. In addition, the random number generator is used to start the play, since a predetermined number is required before a piece can start to move around the board along the serpentine, switched-back paths imprinted thereon. A random number generator can be provided by an electronic means that would be equivalent to one or more dice.

One such electronic random number generator is shown in FIG. 5. This generator, e.g., is a computer with or without electric micro-chips, has number buttons 7, letter buttons 7*a*, and a display 7*b*, such as a television screen. In this connection the television may serve as a display for various indicia. For example, the television may be used to display the magic word for this game by means of a standard input keyboard. One keyboard is provided by the buttons 7 and 7*a* of FIG. 5, which are connected to the television display raster. In the preferred embodiment, however, these magic words are merely communicated orally by the players, or, by pushing buttons 7*a* and 7*c*, synthesized by computer generator 6, which is useful in teaching computer use and awareness.

THE PATHS

The squares 20 imprinted on the board 2 form at least 4 distinctively color-coded playing paths 21 (red), 22 (green), 23 (black) and 24 (blue). Two continuous different lines 25 (for red-blue paths) and 26 (for green-black paths) are each colored by different colors, such as red and green. These lines forms serpentines 27 and 28 that overlap and switch back and forth through each column of squares 20.

The fist (red) line 25 starts in a starting (and ending) zone 9 having a circle (red) 30 at one corner (red) 31 of the board 2 in which the word "start" is imprinted in red. Similarly, the second (green) line 26 starts in the starting (and ending) zone 9, but at a different circle (green) 32 on the diagonally opposite corner (green) 33 of the board 2.

Two other circles (black) 34 and (blue) 35 for paths (black) 23 and (blue) 24 are also provided in zone 9, which comprise the other two diagonally opposite corners (black) 36 and (blue) 37 of the board 2. These circles (black) 34 and (blue) 35 carry the word "start" colored in black and blue respectively.

The red first line 25 carries at least two different red and blue color-coded arrow heads (red) 42*a* and (blue) 42*b* to distinguish the oppositely directed red and blue paths 21 and 24 from each other. Line 25 carries red arrow heads 42*a* pointed in one direction and blue arrow heads 42*b* pointed in the opposite direction.

The green second line 26 carries at least two different green and black color-coded arrow heads 42*c* and 42*d* which point oppositely to each other. Accordingly, the green and black paths 22 and 23 go from their respective starting circles (green) 32 and (black) 34 in opposite directions on the same green line 26, and end up at different places. For example, the green path 22 ends up in zone 9 at a "free land" victory dot 43, and black path 23 ends up in zone 9 at a "free land" victory dot 44. Similarly, the red and blue paths 21 and 24 are oppositely directed to each other and follow the same line 25 from the respective starting circles (red) 30 and (blue) 35 and end up at different victory dots (red) 45 and (blue) 46 respectively.

This has the advantage that one or more players can play individually or in pairs in one or more paths with one or more pieces moving in the same or opposite directions on identical squares on the same board with economy of space and movement. For example, the board shown in FIG. 1 has 100 grid squares which may be used by all of the players, who may use as many as 48 pieces.

THE PIECES

The pieces 3 are distinctively shaped, marked and color-coded so that each species has two pieces for each color-coded path. Also, the pieces have respective interlocking structures 51 and 53 so that pieces of the same or different colors in the same square may land on each other by removably stacking them vertically on top of each other with economy of space and movement so as to be selectively matable.

Referring to FIG. 2*a*, for example, a simulated nuclear missle carring mini-missle piece 61 has penetrating member 51 and a receiving means 53 so that the piece can be mated with any of the other pieces shown in the Figures and vice versa.

Piece 61 is color-coded red to match the red path 21 and to distinguish it from the other pieces 3 that match the other specific paths 22, 23 or 24. Moreover, piece 61 is red but is distinguished from the red piece 62, which includes the same species. To this end, piece 61 has no stripe and piece 62, which is also a mini missle, has a stripe 63, as shown in FIG. 2*b*. Also, pieces 61 and 62 are made from like tokens.

In this preferred embodiment, the pieces 3 may be duplicated so that there are 8 pieces of six species. Thus, four players may play up to 2–12 pieces on any one of the four paths, since ordinarily one player chooses one path.

FIGS. 2*c* and 2*d* illustrate other pieces 65 and 66 in the shape of a mini-submarine 65 with a stripe 63 and a mini-submarine 66 without a stripe. Both pieces 65 and 66 have interlocking structures 51 and 53. Also they are simulated nuclear missile and nuclear torpedo firing submarines. Also, they come in four different color tokens.

Likewise, FIGS. 2*e* and 2*f* illustrate nuclear weapon carrying mini-bombs 67 and 68 with and without a stripe 63. In real life these pieces, like those described hereinafter, would include nuclear devices such as a hydrogen bomb or a conventional atom bomb, which are either self-propelled devices, such as missiles or torpedos, or unpropelled devices such as a mine or a bomb. Interlocking structures 51 and 53 are the same for all pieces so that the pieces may be stacked on top of every other piece. Additionally, each species of piece 3 includes pieces with or without a stripe 63 and are color-coded to match respective paths 21, 22, 23, or 24.

FIGS. *2g* and *2h* are partial elevational views of war ships 69 and 70; FIGS. *2i* and *2j* are two views of aircraft carriers 71 and 72; and FIGS. *2h* and *2l* represent fighter bombers 73 and 74. Each token may be interlocked with every other token by attachment means 51 and 53 and/or magnetically.

There are at least four pieces of each species with stripes and four pieces without stripes. Consequently, at least two pieces of each species may be played on each of the four respective paths. Additional pieces for additonal paths may be added by simply adding additional color paths and matching species of pieces having different distinctive shapes with and without stripes. Tokens and pieces are matable.

PLAYING

Each player is assigned a path and matching pieces, or tokens, which are placed into their respective color-coded starting circles by means of interlocking connectors. As described in more detail hereinafter in the examples a certain number, such as 6, is required on a random number generator, such as dice, for starting a piece from the starting zone.

Other squares requiring a particular number before starting to move therefrom may also be required as discussed in more detail hereinafter. In this connection, however, it is noted that when the "destruction square", which is not in the starting zone, is landed on, there is no particular number on the random number generator that is required before starting to move again when that players turn comes up again in sequence, since the player did not return to his starting place in his path. Thus, if a player's piece is in the reward penalty option zone and lands on a "ZAP" square, that player is penalized but then starts to play when his turn comes up again.

If a player refuses to move his piece from a "ZAP" square to a "destruction" square within a certain time limit, then that player's piece may be eliminated from the game in a simulated nuclear event. However, the rules provide that such a final elimination penalty can only be assessed by the clock correlation means if the player specifically picks a non-joker card without saying the magic word. Advantageously, there are at least three jokers out of a total of 45 cards, since a player has at least three chances to be penalized, as described in more detail hereinafter in the examples.

Ordinarily each player rolls dice to proceed from his respective starting circle to a victory dot along a path that passes through the reward penalty option zone 8. The first person reaching his victory dot wins the game but usually his movements are advanced or retarded by the clock correlation means along the grid squares, i.e., the grid spaces.

CARD DECK

The card deck 4, which is part of the clock correlation means, is used for setting the time of certain penalties. To this end, after starting and then landing on a "ZAP" square in the first reward penalty-option zone 8, which is described in more detail hereinafter, the player is directed to pick a card from the card deck. If the player says the magic word "negotiate" before picking a card, then that player is made "immune" from the penalty that would otherwise be assessed. If that player fails to say the magic word, then that player's piece must return to the "destruction" square for his path or that piece will be eliminated from the game as his penalty. A list of typical indicia on the cards of the card deck, which may contain riddles, nuclear buzz words, stress inducing words etc., and which may or may not have jokers, is given in Table $I_2$.

THE TIME LIMIT

While not necessarily limited thereto, the time limit is understood to be randomly selected. One such arbitrary time is the time within which a particular player must say a magic word before being penalized. This time is arbitrarily and randomly set to expire at the time when a player picks a card from the card deck without saying the magic word, except that picking a joker makes a player immune from a penalty that would otherwise be assessed. Thus, it will be understood that the time limit may be arbitrarily and ranndomly extended by any of a variety of strategies. Examples of such strategies are as follows:

(1) saying the magic word before picking a card from the card deck, or picking a joker to cancel a penalty that would otherwise be assessed;

(2) luckily landing on a square other than a "ZAP" 101 square, which carries first indicia directing a player to "go to the card deck" or return to the "destruction" square 106 close to his home.

(3) using up three to six chances that are allowed for picking a card form the card deck when landing on a "ZAP" square inside or outside the reward penalty option zone 8, or the "nuke blast" square; and (4) going to the card deck when ever a player has to retreat.

In each case, the cards can symbolize the hell of a nuclear event that terminates the time limit for a particular player to stay alive by setting an actual time for penalizung that player if that player picks a card without first communicating the magic word for a simulated offer to peacably settle disputes and potential disputes within the time limit by the heaven of invention. To this end, penalty-option, "go-to", "ZAP" squares 101 and "Nuke Blast" squares 102 in the first reward penalty option zone 8 include first indicia comprising directions for causing the player whose piece lands on this first indicia to either return his piece to a "destruction" square close to the starting point in the second zone 9 or to pick a card from the card deck 4 so as to shorten the time limit to the time before the player picks a card.

While the magic word "negotiate" is preferred as a magic word, the rules may provide for other magic words symbolizing how a particular player may stretch that player's creative imagination for solving disputes by the heaven of invention, which was referred to in Shakespeare's Hennry V. To this end, the magic words may comprise such words for coping with the stress of disputes and potential disputes that easily could escalate in a nuclear age to nuclear destruction, comprising such graduated predictable methods as accomodation, compromise, concilation, settlement, private agreements, fact finding, mini-trials, arbitration, final last offer selection, grievence procedures, mediation, ombudsman, and the use of creative governmental and non-governmental dispute resolution resources, such as appeals to impartial third persons.

In connection with real world stress, it is now known that stress can cause both recoginized and measureable physiological and psychological damage. Moreover, it is believed that such stress can be additive so as to focus on such organs as the cardiovascular system or the bowels. Thus at least a part of such damaging stress may be caused in the real world by being repeatedly exposed to the buzz words of nuclear warfare, and/or by randomly and arbitrarily being subject to a changing time for a person to be penalized by nuclear warfare. This can be simulated or at least symbolically represented, by the random selection of a card from the card deck. Likewise such additive stress may be contributed to symbolically, at least, by the cards in the card deck and the zones 8–17 on the game board 2.

THE ZONES

The clock correlation means 5 governs the movement of tokens and pieces 3 through the ten zones 8–17 that are neutral or that actively or passively retard or advance the time for a penalty. To this end, the time limit is correlated with the positions of the pieces within a certain real time by setting predetermined rewards and penalties that must occur in the first zone 8 within the time limit set. For example, the first zone 8 has first indicia according to a sequence in which a particular player stands pat or advances or retreats toward or away from the beginning of the color-coded paths.

As understood in more detail hereinafter, one must pass first from the starting zone 9 through the reward penalty-option zone 8 and thence to the zone 9 at the end of a path to win the game. Therefore, this zone 9 includes the word "start" in a respective color-coded circle and respective victory labeled dots 43, 44, 45, or 46 at the ends of respective playing color-coded paths 21–24. Accordingly, the starting zone 9 for the red path 21 includes the finishing victory dot 46 for the blue path 24, and the starting circle 35 for this blue path. Likewise the starting zone 9 for the black path 23 includes the green finishing dot 43 and the green starting circle 32 for the green path 22. The red finishing dot 45 and the red starting circle 30 for the red path 21 are at the opposite ends of the red path 21. The finishing dot 44 and the starting circle 34 for the black path 23 are at the opposite ends of the black path 23.

The first zone 8 contains "ZAP" squares 101 and "Nuke Blast" squares 102. These are "go-to" squares. It also contains "escape-2-ZAP" squares 103, which are identified as "Freeze" squares, and neutral "Build up" squares 104*a*. These squares are adapted to correlate play with the ultimate diasters of nuclear destruction. As such, this is the victim's way of being able to cope with the stress of the nuclear age on his way from the beginning to the end of a particular path. These squares also expose a player to nuclear awareness as the matable tokens and pieces move along.

For compactness, the reward and penalty-option zone 8 comprises a portion of the squares 20 between the opposite ends of all the playing paths at the center of the board 2. Four "Free World" reward squares 104 are at the four corners of the zone 8 in or adjacent to other zones and empty squares 104*b*. This provides indicia in a matrix that covers the rectangular-shaped board 2 and intersects with the respective serpentine shaped switchback paths 21, 22, 23 and 24.

For ease of explanation, the ten columns of advancement are identified as 1 through 5 on both sides of the board.

The reward penalty-option first zone 8 has 4 nuclear "Freeze" squares 103. These squares permit a player landing thereon to advance in the same direction or to escape one or two "nuke blast" squares 102 by advancing in a direction normal thereto, i.e., in a direction from the fifth column of advancement in a particular path to the next parallel column of advancement in that path so as to bypass one or two "ZAP" squares 101 in these respective columns of advancement. As described above, these columns are the parallel fifth columns starting from either side of the board. Playing directions of advancement are indicated by the arrows 105 on the board 2.

Some of the "ZAP" squares 101 and some of the "Nuke Blast" squares 102 in zone 8 simulate a "Hiroshima" or a "Nagasaki" scale tragedy. This is understood from the directions which define these tragedies by indicia on the board. This indicia also directs a player to pick a card from the card deck, or to return to the "destruction" square 106 for that player's path. Likewise, the player who picks a card from the card deck must say the magic word "negotiate" first or be penalized by being forced to go back to the "destruction" square 106 in that player's respective playing path. The "destruction" square 106 is in the lowest column of advancement at the beginnning of a player's path, i.e., the first column of advancement. The "ZAP" square 101 extends the time limit set by the game for penalizing a particular player.

The "ZAP" squares 101 and the "Nuke Blast" squares 102 extend the time limit by one amount, if a player prior to picking a card says a magic word. However, that time limit is ended if that player picks a card (except a joker card) before saying the magic word. As a practical matter, both times are randomly set for arbitrary time periods. However, a player by the use of strategy can increase his odds for extending the period for the longest time period by taking 1 token home to the "destruction" square 106. On the other hand, taking 2 decreases that players odds of winning the game by getting to the desired victory dot first. These victory dots are designated by certain indicia spelling out the word "victory" at the end of each player's particular playing path.

The zone 8, includes neutral squares 104*a* carrying indicia for such nuclear weapons words as "build-up". Landing on a square 104*a* does not penalize the player. In this sense it is like the empty squares 104*b*, since the player merely awaits his next turn without advancing or retreating any farther than that neutral square. It thus allows that player to retain his position of farthest token/piece advancement toward that player's goal of landing on that player's victory dot before any other player can do so.

The remaining eight zones are also significant in randomly and arbitrarily extending or retarding the time limit. For example, the third zone 10 comprises a third portion of squares 20 having graphic display means, including third indicia 108 for stress inducing nuclear awareness words that are communicated by one player to all of the other players when that one player's piece lands on a zone 10 square. This makes all the players aware of the hell of nuclear destruction and annihilation on the one hand, and the heaven of survival on the other hand, since that player may have retreated to a "Destruction" space in zone 10 or may have to return to some other such square or zone. The player may also be pat when landing on a zone 10 square, and await his turn again, which comes back in sequence when all the other players have had their one additional turn.

Although not limited thereto, one arrangement for the zone 10 squares can include typical nuclear awareness words for the third zone 10 comprising such stress inducing buzz (i.e., code) words as "nuke war" which is a simulated nuclear holocaust by intention, and such words as "broken arrow" and "nuke-flash", which are indicia for respectively simulating nuclear destruction by an accident that does not risk war or by an accident that does risk war.

The players are thus made aware of the simulated hell of nuclear destruction on the one hand, and the simulated heaven of survival on the other hand, both in the real world and in the play of the game. Survival in the real world and in the game on the one hand, are clearly contrasted with destruction in the real world and in the game on the other hand.

The fourth zone 11 is also part of the clock correlation means for extending the time limit. To this end, zone 11 has another graphic display means, including fourth indicia 112 different from the other indicia in the paths of pieces and symbolizing acts for handling stress in a nuclear age by flight. These acts of flight comprise actual retreat or flight e.g., back four spaces or by entrance into a "no-man's-land." Equivalently, these acts may be symbolized by emotional retreat or flight, comprising building "fall-out shelters", which are in zone 14. This includes building "fall-out shelters," and/or wishful thinking, which is communicated to the other players along with the words for making them aware of alternate means for coping with the stress by a simulated offer to peacably settle the disputes and potential disputes by negotiation as the selectively matable pieces and tokens move.

A still further zone 12, which is another zone that is randomly, sequentially and arbitrarily used for the simulation of the escalation of stress, and which extends the time limit, may be used if desired. This fifth zone 12 accordingly may comprise a fifth portion of the squares in the form of fifth indicia 114 different from the other indicia and having graphic display means symbolizing another way of coping with the stresses of a nuclear age. This includes real world strategies for settling disputes and potential disputes comprising venegance by active retaliation, including verbal aggression by reading buzz word indicia 114, such as "Retaliation" and "ZAP Allies", which stands for the real world strategies of escalating stress by competition, risk taking, posturing, threats, and other real world verbal aggressions.

A sixth zone 13 in contrast to the other zones is adapted to randomly, sequentially and arbitrarily deescalate stress by extending the time limit in which a player is subject to an immediate penalty or elimination when going to the card deck. This sixth zone 13 which is formed by a sixth portion of the squares 20, has sixth indicia 115 symbolizing real world goals for a peacable world, comprising appropriate altruistic concerns for others, such as the words, "feed a hungry world", "economic advancement" and the like.

There is still another zone 14 for randomly, sequentially, and arbitrarily escalating stress. This seventh zone, which comprises a seventh portion of the squares in the playing paths, comprises seventh indicia 116, such as "Play for," symbolizing code words for benign global rationalization, and self-destructive excuses, masquerades, evasions and the underlying fragile feelings of self-worth that can lead to irrational fears and not easily changed desperate diversionary tactics of feigned pretexts and exaggerated facts based upon frustration, alienation, lack of control and the sway of outside forces.

Still another, or eighth, zone 15 symbolizes means for escalating stress. An eighth portion of the squares have instructions on the board itself, including eighth indicia 117 symbolizing the respective real world nuclear and non-nuclear geopolitical concerns and technological fixes selected from the group consisting of "increased accuracy", of strategic arsenals and arms or "dismantle." This contrasts with the euphimistic "hungry world" indicia 115 of the sixth zone 13; vengance by retaliation, including the verbal aggression of the fifth zone 12; and the no-man's land or other retreats of the fourth zone 11. The "Freeze-Dismantle" spaces are in this zone 15.

Additional squares form a ninth zone 16 having ninth indicia 118 of rewards and penalties containing values corresponding in amplitude to the amplitude levels of advancement along the serpentine paths from the first column to the last column. These values are either plus or minus values. In this connection, each path has its own distinctive serpentine, switch-back pattern of parallel columns that includes each and every one of the 100 squares on the board 2. However, each path is distinct since they begin and end at different places in zone 9 and they each have distinctive color-coding. Thus, the paths form parallel overlapping paths in the parallel columns.

For ease of play the board is imprinted with duplicate, opposite facing sides. Each side intersects with the other side in the center line z—z so that there are five columns on each side of the center line.

Since the ninth zone portion of squares carry indicia 118, comprising numbers havng amplitudes corresponding to the level of advancement, these numbers can be used for the pay out of money to increase the enjoyment of the game for those who want such subtleties.

This zone also comprises squares that designate by suitable indicia 118 a number that sends a starter back to the start of zone 9. One example, would be by cancelling the number 3 on the roll of the dice which attempts to move the piece out of the starting circle. 10th zone spaces 17 are blanks.

In operation the various pieces and zones may be used for a variety of purposes. Some of these purposes have been mentioned. However, other purposes will be obvious from the following examples.

(RULES)

EXAMPLE 1

In the operation of one example, including one embodiment of the rules and directions, the game comes with dice and a card deck of at least about 45 cards. Each card lists important information about nuclear weapons and war or riddles. Also provided are 48 distinctive pieces, e.g., six species of eight pieces in four colors having interconnecting means, including flat rectangular pieces that mate in a ½ inch by ½ inch square. Each species of piece has two pieces of each of the four colors. Each color includes a piece of one species with a stripe and a piece of the same species without a stripe.

Each player can use up to 6–12 pieces on one path, and each player is assigned one of four paths for his pieces.

The game should be played with one die, but for faster action, two dice should be used. Alternatively, an electronic random number generator may be used.

To play you must get 6 on the dice to get out of the starting point in a particular path. After getting 6 you need a second throw of the dice to start counting. Each 6 on the die gives you another chance. Each player plays sequentially in turn.

You play by obeying rules on the board. For example, from the starting point, when you throw the dice and get 6, then you must roll 1 on a second chance, for example. If you roll 1 you move out 1 square. Since the first square is marked "free land-victory" plus 5 you will move 5 spaces more. Thus, you will stop in the second "good luck" square. On the other hand, if you get 6 and in a second chance 3, you have to remain in the start point because of the −3.

When you get to the "retaliation" zone you have to retreat to the starting point. The same is applicable when you get to the "nuke flash" square. However, only on your own half of the duplicate sides of the board should "nuke flash" rules be obeyed. On the other hand, all other rules must be obeyed in both duplicate halves of the board.

When you get to a "ZAP" square outside of the center zone 8, you must retreat to the "no-man's land" below your piece in your path. Arrows may be optionally used to this end. Then start playing from there.

When you are in a "fall out shelter" square you must get "1" on the die in order to get out of the square. The same is applicable in the "nuke holocaust" square. In the "good luck" square you must play for "5" in order to continue moving through the squares 20 that form the grid spaces.

When you stop in a "ZAP" square inside the center zone 8 or the "nuke blast" square, you have the option of going to the card deck or retreating to the "destruction" square close to the starting point (or home). You have three chances to go to the card deck in a game when playing with two dice and six chances when playing with one die.

Before going to the card deck you must say or display the word "negotiate" (or some other such word for peacably settling disputes or potential disputes) to the hearing or seeing of the other players. If you forget to say or display the word before going to the deck you will be penalized by retreating to the "destruction" square close to the starting path for that particular piece.

Alternately, it may be determined that the word "negotiate" (or another such magic word) must be said before picking a card, in which case only the turning up of the joker would cause the player to be immune from being so penalized.

You can try your luck on the deck whenever you are required to retreat in the game. If you receive the card written "nuke war, no win situation" you keep playing your game as usual. The card deck may be shuffled at any time by anyone.

Only one die should be used when playing for "1" or "5" when indicated in the last line or column of the game, even when using two dice in the play otherwise.

When playing the game, a player can "ZAP" his opponent when he meets him in the same square or box. Whenever this happens, the first occupant makes his opponent retreat to the starting point. Thus, you will try to manipulate or dodge and "ZAP" you opponent as the case may be.

If you are playing with more than one piece, you can move one or more pieces through the squares at the same time, as long as you got 6 on the die to bring them out of the "start" point. When you use two die at a time, you can make more than one piece move by splitting the numbers on the die between the two pieces, which comprise one or more matable tokens.

EXAMPLE TWO

In another embodiment of another example the game is played with imitation money, which will be provided with the game. Each player will start with $50.00 in the denomination and amounts as follows: ten (one dollar) bills, four $5.00 bills, and two $10.00 bills. This will be won or lost as the minus and plus figures in the game suggest. By each player using two or more pieces, one can manipulate how much he wins.

To win an amount, your piece or pieces must come to a stop on the figures on the board. The same applies for losing, in this case only four players are allowed in a game.

In playing for money you should ignore the minus and plus figures which require you to retreat or advance. Whenever you are in the "ZAP" square outside the center zone 8, or the "nuke blast", or "nuke flash" squares you will give your opponent $10.00 or the balance of your money if it is less than $10.00.

If more than two players are playing, you are required to do the bookkeeping of each players' account as to what he pays out and to whom. Each time your piece meets your opponents piece in the same square, that opponent is required to pay you $5.00. This system is only played for the fun of it.

When only two players are playing the first to reach the "victory" square wins all the money being used.

If four are playing, each player should give up 50% of whatever he has remaining at that time. The second person will get 25%. The third person will take all the rest of the money from the last person.

EXAMPLE THREE

The operation, rules and directions of examples 1 and 2 are selectively repeated. The game is incorporated into a video game like "monopoly" types of games or "chess" types of games which are video machine hookups on a conventional television set. Instead of communicating the magic words orally they are communicated visually by typing in the letters thereof on the screen. Alternately, one key can be used for imagining the entire word on the screen by means of a computer having a memory in generator 6.

EXAMPLE FOUR

The operation, rules and directions of examles 1–3 are selectively repeated. There will be a set of cards issued every year, or every other year, with the latest information about nuclear warfare, as it relates to treaties, space weapons, submarines, aircraft, etc.. Also, this new information will include any new country or countries that have acquired nuclear weapons.

The cards will be sold independently of the board game for those who already have the game. Thus, they may learn more about nuclear weapons when the information comes out.

In another embodiment the card deck will also include comical and humorous jokes, riddles, etc.

EXAMPLE FIVE

The operation, rules and directions of examples 1–4 are selectively repeated for the television (T.V.) embodiment. The T.V. display screen will have an exact replica of the board 2 (with or without the instructions, such as the "go to" cards). These include the "go to" card deck and "instructions", "return to . . . ", "retaliaton", "return to no-man's land", "return to fall out shelter", etc. These instuctions will be eliminated from the screen in most cases, but not the penalties when a player stops at a particular square such as a "ZAP" or a "broken arrow", square.

The game may be played by one or two players using a conventional video type controller or joy stick, such as is illustrated in FIG. 5.

EXAMPLE SIX

The operation, rules and directions of examples 1–5 are selctively repeated according to the following:

How to play

In the case of a two player game, each player will start with 12 or less cruise missiles and rocket look-a-like, etc., pieces which are predetermined for each player before the game starts. This includes one or more stacks of tokens. E.g.,

The T.V. Screen-top

Player A has 1–4 numbered cruise missile rocket pieces or tokens on the right hand side of the screen. The starting point is colored red on the left hand side of the screen, the pieces or tokens being colored red without stripes.

T.V. Screen Bottom

Player B has 1–4 numbered pieces on the right of the screen, the starting point color is red on the left side of the screen, the pieces being colored red with a stripe.

If two are playing you take turns with a player "A" starting first until he is forced to retreat, in which case player "B" will start.

A player can move up to 12 piece-tokens within the board. The movement is controlled by an electronic random number generator, which generates a number. The piece is then moved by pressing the number generated on the controller shown in FIG. 5. As to the number of pieces you want inside the screen at the same time, the controller can be used to set this up. Each piece will be numbered. To move, you have to push the number you prefer to move each time before you direct it by the stick shown in FIG. 5. When your piece stops in the peripheral "ZAP", "nuke blast", or "minus three" square etc., your piece will automatically return back to the point desiganted in the instruction pamphlet but not shown on the screen with a sound blast and a flash. The same thing happens when your opponent lands his piece by landing in the same square as the piece of another player. When this happens, the latter landing piece will automatically return to the starting point. Thus, you have to pause before you move your pieces. The first person to take all eight pieces to his opponents starting point wins the game.

When you push "0" in the controller shown in FIG. 5, a die will be shown as rolling on the screen and it will stop with a number to play or move the piece with the joy stick or controller shown in FIG. 5. Then push on a number in the generator 6 for the controller. That number will be the piece number you will move on the screen. Though you use the stick to move on the screen, you are still guarded by the video from cheating. Also, magic word buttons can cancel penalties.

EXAMPLE SEVEN

The operation steps, directions, and rules of examples 1–6 are selectively repeated. However, the card deck will include cards with questions or riddles without absolute answers to be used for play or for discussion between the players, such as parents and children. Thus, the name of the game is "nuke riddle and awareness game." Typical cards for this example of this embodiment are listed in Table II.

EXAMPLE EIGHT

In another example, the operation, rules and directions of examples 1–7 are selectively repeated. However, the cards are provided and certain of the cards are treated as joker cards.

The first card which is treated as a joker card is the "nuke war, no win situation" card. The rules may provide that the person is penalized or eliminated who does not say the magic word, such as "negotiate", before picking a non-joker card. Advantageously, in this embodiment there may be a total of five such joker cards; also, and a player is only eliminated if he or she does not move his or her piece in a retreat mode to a designated retreat position. However, in this example, when a player has several pieces coupled together on a single square, such as the start square, and then moves those coupled brother pieces together simultaneously, the rules may advantageously provide that a coupled piece has to retreat or be eliminated if it does not retreat as directed.

Additional non-joker cards in the card deck in this example of this embodiment are listed in Table III and/or example fourteen.

EXAMPLE NINE

In another example, the operation, rules, directions, steps and features of examples 1–8 are selectively followed. In this example, rules are provided in written form for becoming a "good listener and communicator", as follows:

1. The First Rule for a good communicator is that eye contact is made with each opposing player when communicating a magic word to the other players, either orally by speaking or by pushing the synthesizer buttons, comprising the button *7c*, which synthesizes the sounds for the word "negotiate" while also visually selectively displaying the same on the television screen of the computer of the electronic random number generator. To this end, the synthesizer button *7c* is held down while the word is spelled out on the television screen by sequentially pushing down the appropriate letter buttons on the computer keyboard in the proper sequence. Accordingly, the computer memory for the sythesizer is properly programmed, as understood in the art, to display the magic word desired. Alternately, a tape recorder can be actuated to cause the word to be sounded by the speaker shown in the drawing by simply prerecording the required message in the manner of a telephone answering machine.
2. The Second Rule for a good communicator is that the listener not interupt the speaker (whether the speaker be speaking the magic word orally himself or by means of a computer systhesizer, with or without visually displaying the spoken magic word). In this connection, since it is impossible to interupt a synthesizer machine, the listener gets in the habit of thinking of spoken words as being produced by a series of electro-mechanical means in a synthesizer machine that cannot be interupted until the message, which in this case is a magic word, is completed. This is especially significant, since it has been found that such procedures reduce the bad effects of stress, and lead to the proper response to stress by coping with it in a healthy manner with good humor. On the other hand, since it is frustrating, and, therefore, stressful to try to interupt a human voice, especially if it is synthesized by a machine that always completes its message, whether someone else is speaking or not, the method and apparatus of this invention teach and condition for the players the proper means and body language for good communication with minimal stress.

3. The Third Rule for good communication is that there is appropriate body language for a speaker and his or her listener, and to this end each player may practice the proper role model for each. To this end, for example, the listener and the speaker may both practice eye contact, as well as its variations by creative invention. Meanwhile, each participant in the dialogue should display the proper posture, stance, and arm position in body language for transmitting a message of concern, participation, and interest on a personal level that is relaxed and substantially without stress inducing symbols and/or movement. This includes, for example, not folding ones arms in front of him or herself, as this transmits a message of self-concern, rather than for the other person in the dialogue, or a message of arrogance or the like.

The rules thus provide a psychic game in the genre of the game described in U.S. Pat. No. 4,443,010, except that the players exhibit their skill in telepathy or other capacities by communicating and reading body language. In this example, a player tries to transmit without any blockage of transmission of the body language chosen. Likewise, the other persons try to receive the message or transmission without any blockage, and, if they succeed, they participate in the concerns of each other. Thereupon, both the sender and the receivers learn to become survivors by the heaven of invention for achieving a natural and peaceful relationship, as opposed to the survival of the fittest by the desacralization of natural hierarchies and/or the hell of nuclear confrontation.

EXAMPLE TEN

In another example, the operations, rules, directions, steps and features of examples 1–9 are selectively followed and/or repeated by unfolding the two halves of the board shown in FIG. 1 along the center z–z axis thereof. Thus, this board is useful and ornamental as an article of manufacture. When opened to a flat surface, the imprinted path lines on the board surface present an ornamental, serpentine-shaped maze, which is an intricately elaborate and complicated design having a pattern of straight lines and circles. This pattern is applied with woven or unwoven strips of string, thread, wood, metal, plastic, ink, paint that is luminescent or unluminescent, plantings and/or the like by any of a variety of means used by contemporary printers, painters, horticulturists, and/or sculptures, including metal workers, wood workers, etc., in the tradition of Jackson Pollack, Henry Moore and/or Martha Graham by planting, printing, painting, sculpting, weaving, serrating, plating, implanting, embossing, inlaying, gluing, welding, soldering, layering, etc. To this end, the pattern is rooted in a primal multiversal conciousness that respects all peoples and views in a spirit of compromise, invention, participation, and cooperative relationships, as opposed to the single minded survival of the fittest cosmology, which was derived from Charles Darwin's ideas, and which was perverted into conquest, racism, etc.

In this example, there are enclosed spaces in the design, comprising circles at the ends of intertwined, overlapping, green and red intaglio or alto bas relief alleyways that are applied to the game board surface in generally concentric or parallel lines forming lanes, aisles and alleyways having a height between about 0.0001 inches to about 10 feet.

In the example, moreover, the described ornamental pattern is applied to a surface having equal area squares printed thereon inside rectangular picture frame-shaped border areas of the surface that contain the circles, so that all of the path lines intersect each and every square, which may be applied before or after the path lines are applied. Also, the red path lines begin and end at a first set of two different circles inside the border area and outside the squares so that the circles are located respectively at different corners of the rectangle. Likewise, the green path lines begin and end at a second set of two different circles inside the border area at the remaining opposite corners of the rectangle from the other circles.

EXAMPLE ELEVEN

In another example, the operation, rules, directions, steps, apparatus, designs and features of examples 1–10 are selectively followed and/or repeated for producing an ornamental design for application to an article of manufacture as shown or described. This includes such multiversal articles as a quilt, hankerchief, game board, and/or sand painting for purposes of psychic and/or healing effects, such as practiced by the American Indians.

EXAMPLE TWELVE

In another example, the operation, rules, directions, steps, apparatus, designs and features of examples 1–11 are selectively followed and/or repeated. One player has 12 pieces of the same color, including 6 unstriped and 6 striped pieces selected from the group of species of pieces consisting of mini-missiles, mini-submarines, mini-bombs, warships, aircraft carriers and fighter bombers. Another player has the same number of striped and unstriped pieces but all his pieces are green. Two more players have like numbers of pieces respectively in black and blue.

Each player stacks his or her pieces on the board in an appropriately colored starting circle that is labeled in the color of the respective pieces. The stacking in this example is aided by pieces containing magnetized iron or other elements in the pieces. Advantageously, the pieces are magntized iron magnets that mutually attract one another when their polarities are appropriately matched.

In this example, each player has a choice of moving all his or her pieces while they are piled up on top of each other as brother and sister pieces that are coupled together by magnetism that mutually attracts the pieces in the starting circles. To this end, the board may be also magnetic for ease of operation. Thus, the pieces may be moved along the board until one or more of them retreat. This may be done by sending a piece back to either the starting circle or the "destruction" square one piece at a time or with more than one piece at a time, in accordance with the strategy of the player. Alternately, a player may choose to loose a piece for not retreating as directed. Still further, a player may choose to keep his brother and sister pieces coupled together as they move along the board by a roll of the dice or the electronic random number generator.

EXAMPLE THIRTEEN

In another example, the operation, rules, directions, steps, apparatus, designs and features of examples 1-12 are selectively followed and/or repeated except that the pieces are stacked together by means of mechanical interlocking elements, including selectively matable receiving and inserting members on each of the pieces.

Each player plays in turn initially by rolling the dice once on each turn. Also, each player is required initially to roll a particular number, such as six, in order to get out of the starting circle. After getting out of the starting circle a player that does not get a high enough random number to pass the "retaliation" square, but instead lands on the "retaliation" square, has the option of picking a card from the card deck or retreating to the starting point. Thereafter, he must obey the above described rules for getting out of the starting zone. The same applies to the "nuke flash" square, except that the "nuke flash" rules only apply on the first half of the two duplicate halves of the board. Thus, only when landing on a "nuke flash" square on a first half of the board when the words are written right side up so that this player can read the right side up words "nuke flash" must this player return to the starting zone or pick a card from the card deck.

On the other hand, when an opposing player on the opposite side of the board lands on the "nuke flash" square on that player's first half of the board so that this player can read these words right side up, then the "nuke flash" rules apply to this player. This will be understood from the figures, which illustrate the two opposite halves of the board by showing that the words are written right side up to players on one side of the board and the same words are written right side up to the players on the opposite side of the board. To this end, the two halves of the board are illustrated by showing the identical two one-quarters of each half of the board.

EXAMPLE FOURTEEN

In another example, the operation, rules, directions, steps, apparatus, designs and features of examples 1-13 are selectively followed and/or repeated except that the cards additionally have different editions, such as those including the following categories:

1. Nuclear weapon information edition
2. Air Force edition
3. Naval edition
4. Marine edition
5. Army edition In the number 2, 3, 4 and 5 editions the cards included comprise additional question and answer formats to those already described and shown. In this connection, the card deck will come with questions and answers for a variety of specific countries of the world, such as the U.S.A., Russia, Argentina, etc. Thus, the military strength of each country, the types of weapons each has available, the number of soldiers in the army, the number of men and women in the navy, and the number of marines and air force personnel will be given in the form of questions and answers. For these editions, however, the person answering the question on the card picked does not pick the card from the card deck. Instead, the opposing player picks the card and the person being directed to pick a card answers the question given on the card, which is read by the opposing player. If the person answering the question can answer correctly, that person gets another roll of the dice, and thus, another chance to advance his or her token. No extra roll is awarded for an incorrect answer. However, the same rules apply for the communication of the magic word. Thus, the person answering the question must say the magic word "negotiate" before answering the question in order to become immune from the penalty of a retreat.

Examples of the cards for any one respective country may also have information without a question, which may be read by an opposing player. For example, suitable cards for the country Argentina might include information on the current events of that country that were gleaned from news reports and/or editorials. In such a case credit is given to the source of the news, and only disparate facts contained in the news are given in rewritten form, as allowed by the fair use exceptions of the copyright law for educational uses and the like. Thus, the editorial in the New York Times edition of Apr. 21, 1984 is rewritten from page 18, as follows:

1. Argentina

Refuses to ratify the Tlatelolco treaty. This treaty would bar Argentina from detonating a nuclear explosion.

2. Argentina

Is now self-sufficient in nuclear technology. It has uranium mines, a uranium enrichment plant, operating nuclear power plants, and a nuclear fuel reprocessing plant for the production of special nuclear material.

3. Argentina

Admiral Carlos Castro Madero has announced that Argentina built a secret plant for enriching uranium. As a result, hope for averting a race in nuclear weapons among Argentina, Brazil and Chile is low.

4. Argentina

Only its reactors are subject to international inspection and/or safeguards. Thus, it is positioned to make an atomic bomb.

5. Argentina

President Raul Alfonsin has refused appeals from the U.S. and Mexico to ratify the Tlatelolco treaty, which would bar Argentina from detonating a nuclear explosion. Also, refusal by U.S. to supply equipment can induce it to go for weapons. 224 Science 952, 6/1/84

EXAMPLE FIFTEEN

In another example, the operation, rules, directions, steps, apparatus, designs and features of examples 1–14 are selectively followed and/or repeated, as follows:

Equipment 48, interfitting, magnetized tokens (pieces), comprising:

1 red mini-missle without stripes
1 red mini-missle with stripes
1 red mini-submarine without stripes
1 red mini-submarine with stripes
1 red mini-bomb without stripes
1 red mini-bomb with stripes
1 red warship without stripes
1 red warship with stripes
1 red aircraft carrier without stripes
1 red aircraft carrier with stripes
1 red fighter bomber without stripes
1 red fighter bomber with stripes
1 black mini-missle without stripes
1 black mini-missle with stripes
1 black mini-submarine without stripes
1 black mini-submarine with stripes
1 black mini-bomb without stripes
1 black mini-bomb with stripes
1 black warship without stripes
1 black warship with stripes
1 black aircraft carrier without stripes
1 black aircraft carrier with stripes
1 black fighter bomber without stripes
1 black fighter bomber with stripes
1 blue mini-missle without stripes
1 blue mini-missle with stripes
1 blue mini-submarine without stripes
1 blue mini-submarine with stripes
1 blue mini-bomb without stripes
1 blue mini-bomb with stripes
1 blue warship without stripes
1 blue warship with stripes
1 blue fighter bomber without stripes
1 blue fighter bomber with stripes
1 blue aircraft carrier without stripes
1 blue aircraft carrier with stripes
1 green mini-missle without stripes
1 green mini-missle with stripes
1 green mini-submarine without stripes
1 green mini-submarine with stripes
1 green mini-bomb without stripes
1 green mini-bomb with stripes
1 green warship without stripes
1 green warship with stripes
1 green aircraft carrier without stripes
1 green aircraft carrier with stripes
1 green fighter bomber without stripes
1 green fighter bomber with stripes
1 game board with duplicate halfs having oppositely facing words and directions and four colored paths
1 set of dice having 6 individual die p1 1 computer memory and keyboard having television or other display screen, such as a LID (light image display) provided by a liquid crystal or the like, and a speaker with a word synthesizer including a battery power source or a wall plug (optional)
1 box of 48 cards having questions and answers on opposite sides.

Object of The Game

Players must follow directions on the board, which has different zones that the tokens pass through within the time limit set by the clock correlation means, including the card deck, which is adapted to teach the use of preselected magic words for peaceably settling disputes. All these zones must be negotiated to win. These zones are located along each of the four differently colored paths on the game board, including a starting and ending zone at the opposite ends of each of the four different paths, which are colored respectively: red, black, blue and green.

The zones, which are adapted to teach nuclear awareness, are as follows:

8. reward and penalty option zone at the center of the board so as to overlap portions of the two halves of the board

9. the starting and ending zone at the opposite ends of the four different playing paths

10. simulated, nuclear age, stress inducing buzz (code) words of nuclear warfare, comprising, "nuke war" by intention, and nuclear (nuke) holocaust by the "broken arrow" of accident that does not risk nuclear war and/or by a "nuke flash" that risks war; these words are written on the board and are communicated to the other players when a player's token (piece) lands in a space on the board containing these words; also, the "Destruction" spaces are in 10

11. acts of flight for handling stress in a nuclear age, comprising actual retreat at least to a "no man's land" and emotional retreat, comprising building fall-out shelters, and wishful thinking that is communicated by a player whose token (piece) lands on words corresponding thereto so as to make the players aware of alternate means for coping with stress by a simulated offer to peaceably settle disputes by negotiation and means selected from the graduated, predictable group consisting essentially of accomodation, compromise, conciliation, settlement, private agreements, mini-trials, fact finding, arbitration, final last offer selection, grievance procedures, mediation, ombudsman, and the use of creative governmental and non-governmental dispute resolution resources, such as appeals to impartial third persons; the former are written on the board and communicated by a player landing in the space containing the words; the latter are the group of words from which the magic word is selected and communicated before picking a card from the card deck

12. words on the board symbolizing aggressive verbal real world strategies for settling disputes and potential disputes, comprising the vengeance of active retaliation and verbal aggression by saying the buzz (code) words "Zap Allies", which stand for the real world active strategies of competition, risk-taking, posturing, threats, and other real world verbal aggressions; also, "Retaliation"

13. words on the board symbolizing real world goals for a peaceable world, comprising appropriate altruistic concerns for others, such as "feeding a hungry world", . . . and words of "economic advancement"

14. words symbolizing benign global rationalization and self-destructive excuses, masquerades, evasions, evasions and underlying fragile feelings of self-worth that could lead to irrational fears and not easily changed, desperate, diversionary tactics, "Play For" feigned pretexts and exaggerated facts based upon frustration, alienation, lack of control, and/or the sway of outside forces 15. words on the board symbolizing the respective real world nuclear concerns and technological fixes selected from the group consisting of "increased accuracy" of strategic arsenals and arms, and dismantling nuclear arms by a "Freeze-Dismantle"

16. indicia on the board representiving values for rewards and penalties, which may correspond to the levels of advancement along the columns for the differently colored paths, which are advantageously arranged in a novel design forming a serpentine-shaped maze, e.g., "Freeland +5," etc.

These words are communicated to the other players when a player's token (piece) lands on a space on the board containing the designated words in the nine respective zones, and like nuclear awareness words are communicated when a card is picked and read after a magic word, such as "negotiate" is first communicated by the player landing on the space. The penalty for not saying the magic word in the time required by the time correlation means, i.e., before the card is picked, is for the player to retreat as directed by the space landed on, the rules, etc. To this end, the penalized player may move one or more tokens in retreat.

17. Empty.

Start of Play

Players roll the dice, or otherwise pick a number ramdomly, with the player rolling the highest number moving first. If two or more players roll the same number, they roll again until the order of play is determined.

Advantageously, each player piles up his or her tokens (pieces) in the starting space. To this end, for example, the following order is established for each player for his respective tokens, e.g., red:

1. red, unstriped mini-missle
2. red, unstriped mini-submarine
3. red, unstriped mini-bomb
4. red, unstriped warship
5. red, unstriped aircraft carrier
6. red, unstriped fighter bomber
7. red, striped mini-missle
8. red, stiped mini-submarine
9. red, striped mini-bomb
10. red, stiped warship
11. red, stiped aircraft carrier
12. red, stiped fighter bomber Each player may use one or more piles, and move a whole pile as a piece or move only one token from the pile at a time by separating the one token from the pile and then moving that token. Thus, each player may have one or two piles of tokens in his respective starting circle, and then proceed to move a pile as a piece, or a token from the pile as a piece.

Each player rolls the dice in turn until he or she gets the required number six on one or more dice for getting a piece out of the starting circle. That player getting the required starting number then gets an extra roll of the dice. To this end, that player may roll as many dice as he or she likes (up to six) to determine how far to move his piece along his or her designated path, e.g., the red path, which is matched to the color of the piece in the starting circle of that player. In one scenario, that one player may decide to move all his striped tokens as a single piece in one unit, while his or her unstriped tokens remain in the starting circle of that player, e.g., the red starting circle. Each player in turn makes his or her own decision as to how many tokens to move at a time, according to the strategy selected by that player.

Continuation of Play

On each player's next turn after his or her starting turn, he or she may roll to get the remain-tokens out of the starting circle on his or her respective path, which is matched to the color of his or her tokens. Alternately, he or she may move any one or more of his or her other tokens as a unitary piece until a retreat is called for.

When a player is called upon to retreat, the piece of farthest advance has to retreat. Thus, if the piece of farthest advance includes several tokens, all these tokens have to retreat at the same time as a single unitary piece. However, if only one token advances to the farthest position of advance for a particular player, only that one token has to retreat.

The player with the first turn rolls the dice and, starting from his or her respective starting circle, moves his or piece the indicated number of spaces along his or her designated path. The first move for each player will end either in a return to the starting circle, the communication of nuclear awareness words in the various zones according to the words printed in the spaces landed on, or a further move, according to the directions on the board. For example, if the dice roll is "1" on any die the player ends up on a space (box) five more spaces from the starting circle. If the roll is "3" on any one die, however, the player must return to the starting circle.

When a player is forced to retreat from a particular space (box) having such a direction, he or she may pick a card from the card deck. If that player says the magic word "negotiate" before picking a card, and he or she picks a joker card, then he or she is immunized from retreating. Thus, saying the magic word and picking a joker card cancels the penalty of a retreat that would otherwise have been forced on that player by a simulated nuclear attack. If that player picks a non-joker card, he or she is not made immune from the indicated penalty to retreat unless by sense the magic work "negotiate" is first communicated to the other players before that player picks that non-joker card. However, if that player says the magic word before picking a card and the card is a non-joker question card, and then that player answers the question correctly, that player gets another turn without retreating as directed.

Play continues with the used cards placed at the bottom of the pile of cards in the card deck.

Any number of tokens may occupy the same space, except that when a player lands in a space already occupied by another token of a different color, the latter landing token may be forced to retreat if the word "Zap" is said by the player of the formerly landing token, which landed first in the same space. This is called "Zapping" an opponent player. However, the latter landing player is immunized from having to retreat if he or she says the magic word "negotiate" and/or picks a joker card.

Retreating Spaces

1. Zap—go to card deck—return to Destruction space (in central reward penalty-option zone #8)

2. Zap Allies—return to no-man's land space; Broken Arrow—Return to Fall-Out Shelter; spaces are zone 12&10 spaces 3. Retaliation—return to starting point; and Zap Allies—retreat to no-man's land space are zone #12 spaces 4. Back Fire −3 (Retreat 3 spaces) is a zone #16 space Retreat Back −4 is also a zone #16 space 5. Nuke Blast—Return To Destruction is also in zone #8

Advancing Spaces

1. Freeze (move laterally from one column to another, as indicated by the arrows on the board, to escape two Zap spaces in central reward penalty-option zone #8)

2. Starting Circle (6 on dice required to move out of starting circle, which is in zone #9)

3. Nuke war is in zone #10

4. No-man's land is in zone #11

5. Feed a Hungry World; and Economic Advancement are in zone #13

6. Free land +5; Freeze +3; Free World +10; Happy World +4 are in zone #16

7. Play for (1 or 5) are in zone #14

8. "Increased Accuracy" of Strategic arsenals and arms, and "dismantle" nuclear arms are in zone #15, including the adjoining two "Freeze-Dismantle" spaces Winning The Game After a player has passed through all the zones and other spaces, such as those that are blank, with at least one token, and including passing through the central reward penalty-option zone, which includes neutral spaces carrying the indicia "Build-up" that is read by the player landing thereon without advancing or retreating until his or her next turn, the player's token must make it into the "Victory" space at the end of a player's path on the exact number rolled. In this connection it is noted that the "Victory" dot space for one player is in his zone #9, whereas the "Free Land +5" indicia for another player is in the latter's zone #16.

The player aiming for his or her "Victory" space at the end of his or her path may use one die in gaining the exact number needed to land in the "Victory" space for that player. If that player overshoots, he or she must wait for his or her next turn. However, when either overshooting or landing exactly on the "Victory" space with the correct number required, that player must successfully pick a card after first communicating the magic word "negotiate" and also answering a question on a card picked by the other players ahead of time. If he or she is on the "Victory" space when this sequence is successfully completed before any other player does so, then that player is declared the winner. If the player overshoots and answers the questions correctly, that player gets another roll of the dice and a chance to answer correctly another question card. If that player does not answer correctly, then he or she has to wait for another turn before attempting to win the game. If he or she fails to communicate the magic word "negotiate" before picking the card, which may include a joker but must include picking at least one question card, then that player must retreat to the "Destruction" space for that player.

Because a correct answer always gives a player another turn, a player may meet the game-winning requirements on the first turn. If this happens, any player may meet the game-winning requirements who has not yet had a turn, since the latter player is allowed to duplicate the achievment of the other player in order to obtain a tie.

The rules contain no provisions about how long a player may take to pick a card or to answer a question and/or about how exact an answer to a question card has to be. Players decide what is a reasonable time at the beginning of play or thereafter. Likewise, they similarly decide how close an answer to a question has to be.

Players should decide ahead of time if a correct answer is to be read aloud after a player has provided an incorrect answer.

This Zap brand nuclear awareness game may be played by one or more players alone or in teams with Zap brand tokens, cards, dice, game boards, designs and other apparatus and paraphenalia. Players determine ahead of time whether help among team members is allowed.

The game board, questions, tokens, designs, cards and clock correlation means are copyrighted 1984 by Donatus O. Enyi based upon publication by the U.S. Copyright Office and/or otherwise by the applicant before publication by the U.S. Patent and Trademark Office.

Advantageously, 1 to 8 players may play the game at the same time. To this end, one player chooses 4 red tokens of 6 different species of tokens without stripes, a second player chooses 4 red tokens of 6 different species of tokens with stripes, etc. (for black, blue, green).

EXAMPLE SIXTEEN

In another example, the operation, rules, directions, steps, apparatus, designs and features of examples 1–15 are selectively followed and/or repeated.

The tokens are flat on the bottom so that they sit evenly on the game board. The receiving means 53 forms a round or a square hole on the bottom of the tokens without in any way interfering with the ability of the tokens to sit evenly on the game board. Likewise, the penetrating member 51 protrudes from the top of the tokens without in any way interfering with the ability of the tokens to sit evenly on the game board. Thereupon, this penetrating member 51 interfits with any other of the game tokens. To this end, the penetrating member has a round or a square cross section to penetrate into the bottom of the receiving means 53, which forms a closely fitting hole that mates with and receives the penetrating member 51 in frictional contact therewith around its entire perimeter.

Ordinarily, the tokens comprise molded material, such as magnetized iron so that the tokens interfit with and stick to each other with a force at least as great as the force of the magnetic attraction between the tokens and the frictional contact therebetween. However, the tokens may alternately be formed from molded plastic having magnetized iron inserts, comprising a hollow hole-shaped receiving means 53 on the bottom of each token, and a magnetized iron containing penetrating member 51 on the top of each token.

Likewise, the game board is advantageously formed from magnetized iron. This iron may be in two adjacent thin sheets of steel upon which is printed the required indicia, paths and boxes forming the desired 100 spaces. Alternately, each space may be a magnetized insert forming a penetrating, pin-shaped member 51 protruding therefrom. Thus, the tokens may be piled up on this magnetized iron penetrating member 51, which protrudes from the game board surface. This is particularly advantageous in an outdoor version of the game and game board, which may be formed from living plants or a sand painting to provide an outdoor maze design defining the maze-like paths on the game board.

Still further, the steel sheets may be overlaid with a cloth or paper sheet that is printed or woven with the required indicia, paths and 100 box-shaped spaces, which may be selectively placed on or removed from the underlying steel sheets, or glued thereto. The pins may simply pass through the weave of the cloth and easily removed therefrom if the printed sheet is not glued on to the steel sheets.

EXAMPLE SEVENTEEN

In another example, the operation, rules, directions, steps, apparatus, designs and features of examples 1–16 are selectively followed and/or repeated.

The game board is formed on a paper, cardboard, wooden, plastic or cloth sheet, quilt or hankerchief. This enables the desired indicia, paths, and 100 block-shaped spaces to be printed or woven, as is appropriate, and temporarily or permanently placed on top of the flat surface underlaying the same. The bottom, underlying surface that supports the printed or woven sheet is formed from the steel sheets, for example. Thus, the steel sheets are the sheets attracted by the magnetism of the tokens.

Alternately, the steel sheets carry needle-shaped steel pins containing iron that penetrates the cloth and penetrates into mating holes in the bottom of the tokens, or vice versa.

In this example, the tokens carry penetrating members 51 forming needle-shaped steel pins that extend from the top of each token so as to fit into mating holes in the bottom of each of the other tokens. Since steel contains iron, these pins selectively may be magnetized as permanent magnets that require only a small selective force to separate two or more tokens that are magnetically attached to one another according to the strategy employed by an individual player for forming one or more multi-token pieces.

When folding the board along its central z—z axis, the paper, cardboard, wooden, plastic or cloth sheet forms a flexible fold between the two separate and adjacent steel sheets. These steel sheets advantageously stick to but may be selectively removable from the game board in one example, since the pins penetrate between the threads of a woven cloth, quilt, hankerchief, or other such article of maufacture.

This invention has the advantage of providing a nuclear awareness game. This invention also has the advantage of teaching nuclear awareness. Still further, this invention has the advantage of providing ornamental designs, which are applied to an article of manufacture for teaching specific skills, such as body language and the art of resolving disputes by peaceful means. For example, this invention has the advantage of providing an ornamental, serpentine-shaped maze, which is applied to a game board for teaching the use of magic words for peaceably resolving disputes that can escalate easily into simulated nuclear war. These magic words may be communicated orally or synthetically by the spoken word or by visually displaying the magic word on a television screen that is coupled to a computer terminal that may incorporate a random number synthesizer. While a wide variety of magic words may be used by the creative genius of the players, who may invent and transmit code words and symbols by body language, by the spoken word, or visually on a television set, the preferred magic word is the word "negotiate" for teaching the simulated heaven of survival by providing a simulated offer to peacably settle disputes and potential disputes by the heaven of invention within a predetermined time limit. Also this invention has the advantage of providing a clock correlation means governing the movement of pieces by setting a time limit for correlating the position of the respective playing pieces with first and second zones according to a sequence in which a particular player is penalized in the simulated hell of a nuclear event if that player does not first communicate a magic word for the simulated heaven of survival comprising a simulated offer to peacably settle disputes and potential disputes by the heaven of invention within the time limit. Since the magic word "negotiate" is preferred, this game also has the advantage that it can be called "Negotiation" in a still further emboidment, particularly since the simulated atom bombs of this game may be carried on a suitcase and placed anywhere a suitcase may be carried or placed; and this game may also make the players aware of such a mundane life-death situation, which could easily eliminate man-kind from the world. To this end, the random number generator may contain a computer and memory means hooked up to the television, which, with modern technology, only requires the pushing of a button. Still further, the tokens and/or pieces of the game are selectively matable so that one or more tokens make up a piece, according to the strategy used.

TABLE $I_2$

| (CARDS) |
|---|
| 1. Nuke War No Win Situation (Free) (Joker) |
| 2. Nuke War No Win Situation (Free) (Joker) |
| 3. Nuke War No Win Situation (Free) (Joker) |
| 4. Any first use of Nuke against the Soviet Homeland by Western Europe would be suicidal for the West, and would result in the destruction of Western Civilization as we know it today. Because the Soviet will definitely unleash its might of destruction in response to such an attack by Europe. |
| 5. Nuke Nations<br>About 6 nations are believed to have Nukes: USA, USSR, China, France, Britain, India and (possibly South Africa and Israel) and the number may grow. |
| 6. Try Again!<br>Enjoy the freedom of Liberty<br>Negotiation |
| 7. Try Again! You still have to stay where you are. |
| 8. Sorry! You still have to stay where you are.<br>Better luck next time. |
| 9. In a total escalation of Nuke war about 2 billion people will be casualties.<br>USA and USSR have roughly between them about 40,000 nuclear (weapons) warheads. This is one million times the power of Hiroshima's one atom bomb. USA = 26,000 warheads; USSR = 34,000.<br>Launch on warning = fire back before USSR nukes touch US soil. |
| 10. Underground Silos<br>Storage places for Nukes on land. |
| 11. The First Nuke<br>It was detonated in 1945 at Alamogordo, New Mexico, USA.<br>MDP = Mutual Destruction Pact<br>MAD = Mutual Assured Destruction<br>INF = Intermediate-range nuclear forces |
| 12. MX Missiles<br>They are under production, adding more killer monsters to existing arsenal (USSR isn't sleeping either). |
| 13. Britain and France |

TABLE $I_{2\text{-}continued}$ (CARDS)

They have 126 nuclear war heads (aimed at USSR)

14. Broken Arrow

Accident which risks nuke being detonated-but doesn't risk war between the two superpowers, i.e., between the USA and the USSR.

15. There is no such thing as limited nuclear war. Deterrence is very essential. What is the limit?

16. Unverifiable Treaty

Unilateral freeze and unverifiable treaty is suicidal.
Nuke war is a no-win situation.

16. ABM

This is an anti-ballistic missile, which may risk war, and may prevent war.

ICBM

This is an intercontinental ballistic missile.

17. Super myth

This is the myth that the US president or anyone else can trigger nuke missiles by just pressing a button. It is more complex than that, and it involves many high officials and procedures.

Fallout Shelters

These are myths because of the danger of radiation. Fallout shelters can only protect against blast damage.

18. Nuc Flash

This is an accidental or an unauthorized detonation of a nuke. This risks war between the USA and the USSR.

19. Two Societies

West Block: Public opinion changes things - forces changes in politics.
East Block: Public opinion is mute!
Enjoy the freedom of liberty.

20. Treaty

SALT = Strategic Arms Limitation Talks
START = Strategic Arms Reduction Talks

21. USSR has more than 300 SS-20 missiles capable of being targeted on Western Europe, and the number is rising. (each SS-20 has 3 warheads.)

21. USSR Destructive Force

Their nukes = 7868 megatons in 8040 warheads, and the number is still rising.
One megaton is capable of destroying about 20 square miles of a city; one megaton = one million tons of TNT.

22. You may love your enemy

However, if you take him for granted he'll crush your brain for you.
USSR carried out atmospheric nuke tests in 1945–1963 in violation of their own words.

23. Faded Giant

This term is used when a military nuclear reactor is involved in an accident. This accident risks nuclear radiation leakage to the atmosphere.

24. Space Warfare

Laser Warfare

These are in full swing for the creation of new ABM's.

25. Bent Spear

This is defined as a significant accident that involves a nuke but not the risk of detonation.

26. Nuke Proliferation

This is the spread of nukes in the world at a rapid pace.
Non-nuke proliferation = curtailment of the spread of nukes . . . especially by nations who don't have them at this time.
Non-proliferation agreement.

27. The Freeze Movement

Many Americans now think that the Europeans want to be under the protective umbrella of NATO without sacrificing themselves defensively.

28. Stockpiles

There are 6000 nuclear warheads stockpliled now in Western Europe. Some of these stockpiles are now obsolete.

29. Zero Options

USA flexibility: At the INF talks, US withdrew its hard-line "zero option", which stands for total withdrawal of Soviet SS-20's that are already aimed at Western Europe. The exchange would be for NATO's no-deployment. USSR objected. It asked for only a reduction of its own missiles and no NATO deployment whatsoever.

30. Nations that may have bomb soon:

Libya, Iraq, Egypt, Spain, South Korea, Argentina Brazil, Denmark, Belgium, Finland, Yugoslavia, Australia, Austria, Norway, Taiwan and the Netherlands.
Western nations are possible suppliers of the know-how and technology for nuclear proliferation.

31. You are out of luck:

You are caught up by Electro Magnetic Impact,

32. Ranges:

ICBM - 5,500 kilometers or more
INF - 2,200 to 5,500 kilometers
Intercontinental Bombers with nuke capability
USA B-52 and B-1 (unlimited with air refuel)
USSR Bear and Bison Bombers (unlimited with air refuel)

33. NATO:

North Atlantic Treaty Organization has Pershing and Cruise Missiles, which are now deployed in Western Europe. Planned deployment = 572. Only seven minutes to USSR target. Range = 1500 miles.

34. USA:

Destructive nuke force = 3505 megatons in 9480 warheads and still rising.
One megaton is capable of destroying about 20 square miles of a city. One megaton = one million tons of TNT

35. PAL:

Permission Action Links. This is a device that makes detonation of warheads from any one else impossible without specific electronic or mechanical command from the President. The USSR lacks this PAL device.

36. SLBM:

Submarine launched ballistic Missiles.

37. Britain and France:

They have 126 nukes of their own outside of NATO.

38. Projected US-USSR nuclear capability:

(Without SALT treaty = Escalation of arms race)

| | | ICBM | SLBM | Bombers | Vehicles | Tons (Mega) | Warheads |
|---|---|---|---|---|---|---|---|
| USA | 1985 | 1052 | 664 | 348 | 2064 | 4200 | 13,300 |
| USSR | 1985 | 1500 | 1100 | 140 | 2740 | 9,200 | 10,000 |
| USA | 1990 | 1350 | 720 | 450 | 2550 | 7,100 | 18,000 |
| USSR | 1990 | 1700 | 1,300 | 200 | 3200 | 13,000 | 20,000 |

39. DSP:

Defense Support Program. This is the satellite system that provides the USA with about 25 minutes warning when the Soviets launch their ICBM's and about ten minutes for SLBM's against the USA

40. BMEWS:

Ballistic Missle Early Warning System. This is a back-up system to DSP, but it also provides accurate estimates of where the enemy nuke will land.

41. Third Back-up System:

PAVE PAWS is similar to BMEWS. Both systems provide between 5 to 15 minutes warning of TABLE $I_{2\text{-}continued}$ (CARDS)

intended targets.

42. Survival:

Roughly about 30 to 40 percent of US ICBM's will survive a Soviet first strike.

43. Peacetime:

In peacetime the USA maintains about 40 nuclear submarines at sea.

44. War time:

During crisis the number would probably double. USA also maintains about half of its intercontinental bombers (B-52) with nuke capability on alert status during peacetime = Vigilence!

45. Pershing II Missiles:

These missiles have a range of about 1800 km. They have pin-point accuracy by the use of radar-assisted guidance systems. Target miss is less than 100 feet.

TABLE II (Supplements to Cards)

46. Target Misses:

ICBM's about 600–1000 feet (US)
ICBM's about 1000–1500 feet (USSR)
SLMB's about 1500 feet (USA)
SLMB's about 3000 feet (USSR)

47. Permissive Action Links:

Almost all US nukes are equiped with PAL's to make them detonation-proof for would-be terrorists.

48. Nuke forces:

| | India | Britain | China | France |
|---|---|---|---|---|
| ICBM's | — | — | few | — |
| SLBM's | — | 64 | — | 80 |
| Bombers | few | 60 | 100+ | 40 |
| IRBM's | — | — | 100+ | 18 |

TABLE III (Nuke Riddle and Awareness Game Cards)

1. How many people will survive a nuclear attack on your city?
2. How many countries will have a nuclear capability in the next twenty years?
3. How many people will die in a limited nuclear attack on your country? In unlimited nuclear attack?
4. How many people will die due to the after effects of a nuclear war? By radiation?
5. How many nuclear submarines do the USA and the USSR have?
6. What is the name of the country the superpowers usually hold nuclear arms reduction talks in? What is the name of the city?
7. Would you like your country to have its own nuclear weapon if it does not now have one of its own at this time? Why? Why not?
8. What is the price for a one megaton nuclear weapon? (Include cost of production)
9. What will the world do with all the nuclear weapons that they are producing if they won't ever be used?
10. How many years will it take to escalate space warfare? What will space warfare be like? In the year 2000?
11. Between the USA and the USSR, which will probably win a nuclear war?
12. How many nuclear weapons should we have before we stop the pile-up? What is enough deterrent?
13. In a conventional war between the Eastern Block and the Western Block, who do you think will win? What if there is nuclear war?
14. Should public opinion be a determinant force in forming government policy on nuclear armament or disarmament? What about in Eastern Block nations?

Etc

TABLE $I_1$

As understood from the 3/6/84 NY Times, page C1 et seq., which is incorporated by reference herein, the use of excuses can now be explained scientifically. Also, as described in the May 22, 1984 NY Times, which is incorporated by reference herein, body language, which includes facial expressions, can be accurately read by persons, as well as by objective measuring means. This includes communication of specific negative and positive emotions, including lack of stress and/or open digust, etc. This is important, since the suppression of negative emotions, such as sadness, hopelessness, and loneliness may suppress immune functions so as to lead to disease.

The system of objective measurement can be reduced to formulae for describing 80 specific muscular responses, e.g., Anger=1, 2, 13, 25, 55; Smile=12, 20, 25, 53, 56 for two seconds or more if genuine; Smile of criticism=12, 24, 41, 56; Reluctant, compliant smile=1, 2 asymmetrical 12.

What is claimed is:

1. A nuclear awareness game comprising:

a. a game board having imprinted thereon a plurality of squares, b. distinctively color coded play paths formed across the plurality of squares arranged in at least two oppositely directed serpentine lines having a generally rectilinear switched-back arrangement intersecting every square on the board, c. distinctively color coded playing pieces that are moveable along a playing path according to a sequence that is distinctively matched with the color coding of respective playing paths;

d. squares forming a first portion of the board including distinctive first indicia for the players and playing pieces, forming a first rewardpenalty-option zone;

e. a second portion of the board, including spaces having distinctive second indicia different from the first indicia, forming beginning and ending zones for the players and playing pieces at the opposite ends of each of the playing paths; and cards with indicia relating the play and being a clock correlation means for governing the movement of the pieces by the players.

2. The game of claim 1 in which the clock correlation means is operable with a third portion of the board having third squares forming a third zone in said first zone for randomly and sequentially extending the time limit, said third zone having graphic display means, including third indicia different from the first and second indicia in the paths of the pieces symbolizing simulated, nuclear age stress inducing, buzz words of nuclear warfare, comprising "nuke war" by intention, and nuclear holocaust by the "Broken Arrow" of accident that does not risk war or by a "nuke Flash" that risks war, the buzz words being communicated when a player's piece lands on the third indicia so as to make the players aware of the hell of nuclear destruction and annihilation on the one hand, and the heaven of survival on the other hand.

3. The game of claim 2 having means for communicating the word "negotiate" orally by spoken word.

4. The game of claim 3 having means for communicating the word "negotiate" visually.

5. The game of claim 4 in which the card deck contains a joker, which makes the player picking the joker immune to a penalty, and a plurality of additional cards carrying additional means for extending the time limit by symbolizing additional simulated, nuclear age, stress inducing buzz words of actual, physical, nuclear warfare that are communicated by a player that picks one of these cards so as to make the players aware of the stress that results in a nuclear age by the escalation of disputes and potential disputes to the point of complete nuclear destruction and annihilation in a nuclear war.

6. The game of claim 5 in which fourth squares in the playing paths form a fourth zone for randomly and sequentially extending the time limit, said fourth zone having graphic display means, including fourth indicia different from the first through the third indicia in the paths of the pieces symbolizing acts of flight for handling stress in a nuclear age, comprising actual retreat at least to a no-man's land, and emotional retreat, comprising the building of "fall-out shelters," and wishful thinking that is communicated by a player whose pieces lands on the fourth indicia so as to make the players aware of alternate means for coping with stress by a simulated offer to peaceably settle the disputes and potential disputes by negotiation and first means selected from the graduated, predictable group consisting essentially of accomodation, compromise, conciliation, settlement, private agreements, mini-trials, fact finding, arbitration, final last offer selection, grievance procedures, mediation, ombudsman, and the use of creative governmental and non-governmental dispute resolution resources, such as appeals to impartial third persons.

7. The game of claim 6 in which a fifth portion of the squares in the playing paths form a fifth zone for randomly and sequentially extending the time limit, said fifth zone having graphic display means, including fifth indicia different from the first through the fourth indicia in the paths of the pieces symbolizing aggressive verbal real world strategies for settling disputes, and potential disputes, comprising the vengeance of active retaliation and verbal aggression by saying buzz words, which stand for the real world active strategies of competition, risk taking, posturing, threats, and other real world verbal aggressions, said fifth indicia being different from the first through the fourth indicia.

8. The game of claim 7 in which a sixth portion of the squares in the playing paths carry sixth indicia symbolizing real world goals for a peacable world, comprising appropriate altruistic concerns for others, comprising "feed a hungry world", "economic advancement". . . and other words of economic advancement.

9. The game of claim 8 in which a seventh portion of the squares in the playing paths carry seventh indicia symbolizing code words for benign global rationalization, and self-destructive excuses, masquerades, evasions and underlying fragile feelings of self-worth that could lead to irrational fears and not easily changed, desperate, diversionary tactics of feigned pretexts and exaggerated facts based upon frustration, alienation, lack of control, and the sway of outside forces, said words including the words "Play For", and the sixth indicia being different from the first through the fifth indicia.

10. The game of claim 9 in which the game board is rectangular and has at least four color-coded starting and ending points forming the second portion of the board in spaces forming beginning and ending zones adjacent to the four corners of the board and the squares so as to be interposed therebetween, the path lines crossing in the end squares so that each respective path starts on the same side of the board that it finishes.

11. The game of claim 10 in which the game board has duplicate, opposite-reading sides for opposing players on opposite sides of the board.

12. The game of claim 11 in which an eighth portion of the squares have instructions on the board itself, including eighth indicia symbolizing the respective real world nuclear concerns and technological fixes selected from the group of increased accuracy, strategic arsenals and arms, and dismantling, which includes two spaces labeled "Freeze Dismantle".

13. The game of claim 12 in which the card synchronizing and clock correlation means includes at least means for randomly selecting numbers for starting and governing movement of the playing pieces along the respective paths.

14. The game of claim 13 in which a ninth portion of the squares have ninth indicia of rewards and penalties containing values corresponding to the levels of advancement along the columns for the serpentine paths.

15. The game of claim 14 in which the first zone contains contiguous squares forming a reward and penalty-option zone at the center of the game board.

16. The game of claim 15 in which a tenth portion of the squares contain tenth indicia different from the other indicia specifying a number on a die that sends a player back to a place near the start zone.

17. The game of claim 16 further comprising one or more dice for random number selection.

18. The game of claim 17 in which the playing pieces have portions for mating at least two distinctively shaped and color-coded pieces together when they land on each other, in which the ninth portion of the squares carry money paying amounts written thereon for a player whose piece lands thereon, and in which the board contains squares carrying a change-of-direction label, including at least the direction to change the position of a piece in the first zone.

* * * * *